US006386267B1

(12) United States Patent
Kagan

(10) Patent No.: US 6,386,267 B1
(45) Date of Patent: May 14, 2002

(54) NON-ROTATING, LEVITATING, CYLINDRICAL AIR-PILLOW APPARATUS AND METHOD FOR SUPPORTING AND GUIDING AN ENDLESS FLEXIBLE CASTING BELT INTO THE ENTRANCE OF A CONTINUOUS METAL-CASTING MACHINE

(75) Inventor: Valery G. Kagan, Colchester, VT (US)

(73) Assignee: Hazelett Strip-Casting Corporation, Colchester, VT (US)

( * ) Notice: Subject to any disclaimer, the term of this patent is extended or adjusted under 35 U.S.C. 154(b) by 0 days.

(21) Appl. No.: 09/364,439

(22) Filed: Jul. 30, 1999

(51) Int. Cl.[7] ..... B22D 11/06
(52) U.S. Cl. ..... 164/432; 164/481
(58) Field of Search ..... 164/429, 479, 164/431, 432, 481; 198/811

(56) References Cited

U.S. PATENT DOCUMENTS

| | | | | | |
|---|---|---|---|---|---|
| 2,640,235 | A | | 6/1953 | Hazelett | 164/87 |
| 3,036,348 | A | | 5/1962 | Hazelett et al. | |
| 3,041,686 | A | | 7/1962 | Hazelett et al. | |
| 3,937,270 | A | | 2/1976 | Hazelett et al. | 164/50 |
| 4,002,197 | A | | 1/1977 | Hazelett et al. | 164/250 |
| 4,061,177 | A | | 12/1977 | Sivilotti | 164/87 |
| 4,061,178 | A | * | 12/1977 | Sivilotti et al. | 164/481 |
| 4,062,235 | A | | 12/1977 | Hazelett et al. | 73/159 |
| 4,082,101 | A | * | 4/1978 | Hazelett et al. | 134/127 |
| 4,190,103 | A | | 2/1980 | Sivilotti et al. | 165/120 |
| 4,537,243 | A | * | 8/1985 | Hazelett et al. | 164/481 |
| 4,635,703 | A | * | 1/1987 | Nakato et al. | 164/443 |
| 4,648,438 | A | * | 3/1987 | Hazelett et al. | 164/475 |
| 5,083,657 | A | * | 1/1992 | Kelsey | 198/811 |
| 5,133,402 | A | | 7/1992 | Ross | 164/431 |
| 5,728,036 | A | | 3/1998 | Kagan et al. | 492/8 |
| 5,967,223 | A | * | 10/1999 | Kagan et al. | 164/481 |
| 6,062,377 | A | * | 5/2000 | Mensch | 198/811 |
| 6,123,186 | A | * | 9/2000 | Schwerdtfeger et al. | 198/811 |

* cited by examiner

*Primary Examiner*—M. Alexandra Elve
*Assistant Examiner*—Kevin P. Kerns
(74) *Attorney, Agent, or Firm*—G. Kendall Parmelee

(57) ABSTRACT

A non-rotating, belt-levitating, cylindrical air-pillow apparatus supports and guides a moving, tensed, flexible, heat-conductive casting belt along a convex, cylindrically shaped path toward an entrance into a continuous casting machine. Pressurized air is applied in belt-levitating relation to the inner surface of the casting belt moving along the path. Stationary belt-guiding elements define the path. Pressurized air is fed through throttling passages communicating with regions between stationary elements or communicating with outwardly facing stationary plateau surfaces. A cylinder shell supports the stationary elements and is adjacent to a plenum chamber feeding pressurized air through throttling passages in the shell. Stationary elements of suitable, durable, wear-resistant, slippery material are mounted in grooves in the shell. The air-pillow apparatus includes belt coolant application deflector or nozzles.

57 Claims, 14 Drawing Sheets

NON-ROTATING, LEVITATING, CYLINDRICAL AIR-PILLOW APPARATUS AND METHOD FOR SUPPORTING AND GUIDING AN ENDLESS FLEXIBLE CASTING BELT INTO THE ENTRANCE OF A CONTINUOUS METAL-CASTING MACHINE

FIELD OF THE INVENTION

This invention is in the field of continuous metal-casting machines having a substantially straight or flat moving mold cavity or mold space wherein a casting belt or belts travel from an entrance into and along the mold space to an exit therefrom. The term "substantially flat" herein includes such gentle longitudinal curvature as may assist in keeping a single tensed travelling casting belt against backup means in the moving mold casting space and also includes such gentle transverse curvature as may assist in keeping the belt in firm contact with the surface of metal being solidified in the moving mold space.

BACKGROUND

Casting belts in continuous casting machines for continuously casting molten metal are formed of suitable heat-conductive, flexible metallic material as known in the art, having a thickness for example in a range from about 0.3 millimeters to about 2 millimeters. Such a belt is revolved under high tensile forces around a belt carriage in an oval path. During revolving, each belt has, in the prior art, continuously passed around a rotating entrance-pulley drum and a rotating exit-pulley drum positioned respectively at entrance and exit ends of the moving mold.

A persistent problem in the use of such machines has been a spatial limitation alongside the inner surface of the casting belt near an entrance region of the casting space where molten metal first contacts the belt as the belt separates from the rotating entrance pulley drum. In the prior art as disclosed in patents of Hazelett et al., referenced above, this spatial limitation can be seen in a side elevation view. This limitation occurs in the form (shape) of a cusp defined between a belt's inner surface and a downstream half of the rotating entrance-pulley drum in a region where the moving belt tangentially separates from this pulley drum.

In this space-limited "cusp region," precise control of belt distortion is desired because this is the place where very hot incoming molten metal first contacts the moving belt.

A substitute for a rotating entrance-pulley drum was disclosed by Sivilotti et al. in U.S. Pat. Nos. 4,061,178 and 4,061,177. A multiplicity of hydraulic flotation "spools" defined and supported the belt path. These spools were disclosed using absolute air pressure less than atmospheric—a partial vacuum—to exhaust coolant liquid away from the spools and to force the belt almost against the spools.

Forces associated with such partial vacuum have been found to be insufficient to stabilize casting belts enough to ensure casting of high-quality product. Sivilotti (in U.S. Pat. No. 4,061,177, column 19) disclosed coolant preheated to 40 to 70° C. to help stabilize the belts.

However, resulting high partial pressure of water vapor issuing from hot water limited the partial vacuum achievable by Sivilotti et al.

Moreover, water or coolant temperature even at 70° C. is too low for adequate belt preheat to enable casting high-quality product.

Yet, coolant temperature at 55 to 70° C. (131° to 158° F.) presents danger of scalding personnel it this hot coolant were to get out of control as through a defective belt or broken conduit.

Consequently, equipment disclosed in these patents did not solve problems of suitably stabilizing a casting belt and ensuring casting of high-quality product.

It is known that smooth solid objects can be "floated" very close to smooth solid surfaces by means of fluid interposed between them under pressure. However, when one of the objects is flexible and is moving and also is curved, serious problems arise, such as generation of intolerable screeching noises and belt vibrations when attempting to use compressed air for "floating" a casting belt moving along a curved, stationary support surface.

SUMMARY

I have found a non-rotating, fixed, rigid, convex, generally cylindrically curved, levitating "air pillow" belt-guiding apparatus which is much less complex than a multiplicity of spools with scalding hot coolant and partial vacuum. Also, I find that this air-pillow apparatus can be devised to overcome or substantially reduce the above problems. The air-pillow apparatus disclosed herein enables an endless, thin-gauge, flexible casting belt in a continuous casting machine to be deflected, curved, or reversed in its course while making available the space formerly occupied in most belt-type machines by the downstream half of the rotating entrance-pulley drum. The space so saved becomes available for improved belt cooling and support apparatus to be employed in this critical zone which includes the above-defined "cusp region" where molten metal first contacts the casting belt.

In a preferred mode of the invention, levitating air (or other gas) is introduced under controlled pressure and volume into a thin, semi-sealed space or spaces between the moving curved inner surface of a casting belt and the convex-curved, generally cylindrical air-pillow apparatus, thereby enabling the casting belt to revolve in its usual path, with only a minimum of friction. In addition, and advantageously, normal belt tension can be applied to the belt during operation.

Preheating a casting belt controls thermally-induced strains in the belt, thereby keeping the belt flat so that the solidifying molten metal being continually cast is protected from disturbance by unpredictable, sudden distortions which otherwise would occur due to thermally-induced strains in the belt where the belt is adjacent to hot metal. Belt preheating enables casting high-quality product. Belt preheating is disclosed in several U.S. Patents assigned to the Assignee of this application.

Flowing room-temperature compressed air against a preheated belt does not much alter its preheat. On the other hand, contact of a hot belt, for example with room-temperature coolant would considerably reduce belt temperature where such coolant contacts the belt. Dry belt preheating, for example by radiant heating, is facilitated by employing the present invention. Among advantages of using dry preheating are those resulting from avoiding use of dangerous, scalding-hot preheating coolant such as in the '178 arid '177 patents discussed above. Moreover, using hot water in a room where a casting machine is located will saturate ambient air with water vapor. This air-borne moisture may condense as droplets on casting belts and may cause minor explosions when such droplets are struck by molten metal. Also, high humidity near a casting machine is debilitating on workers performing jobs requiring alertness and continual careful attention, with quick and skilled responses needed for controlling parameters of ongoing continuous casting.

BRIEF DESCRIPTION OF THE DRAWINGS

Other objects, aspects, features and advantages of the present invention will become more fully understood from the following detailed description of presently preferred embodiments considered in conjunction with the accompanying drawings, which are presented as illustrative and are not necessarily drawn to scale or orientation and are not intended to limit the invention. Large outlined arrows point "downstream" in a longitudinal (upstream-downstream) orientation, indicating the direction of product flow from entrance to exit of the continuous casting machine.

FIG. 9 shows decreasing curvature (enlarging radii) of transitional curves provided by the belt-path-determining shape of the air-pillow apparatus guiding moving belts into the moving mold.

DETAILED DESCRIPTION OF THE PREFERRED EMBODIMENTS

This specification will proceed in reference to twin-belt casting machines, which typically have upper and lower carriages for revolving upper and lower casting belts. The revolving belts define a moving mold casting cavity or mold space between them. The belts are travelling from the entrance into the moving mold space and along the mold space to the exit. The belts bear and confine between them incoming hot molten metal and they cool and confine the resulting freezing molten metal for providing a solidified metal product fed out from the exit.

In a twin-belt casting machine, the pass line, which is the path followed by the freezing metal filling the mold M, is generally straight. In a single-belt machine (riot described herein), the pass line may be a slightly curved convex path as seen from the side.

As used herein the terms "cylindrical surface," "cylindrical shape," "cylindrically shaped," "cylindrical" and "cylinder" are intended to be broadly construed so as to include cylindrical surfaces having a circular curvature and cylindrical surfaces having a convex curvature which varies from circular.

Figure 1:
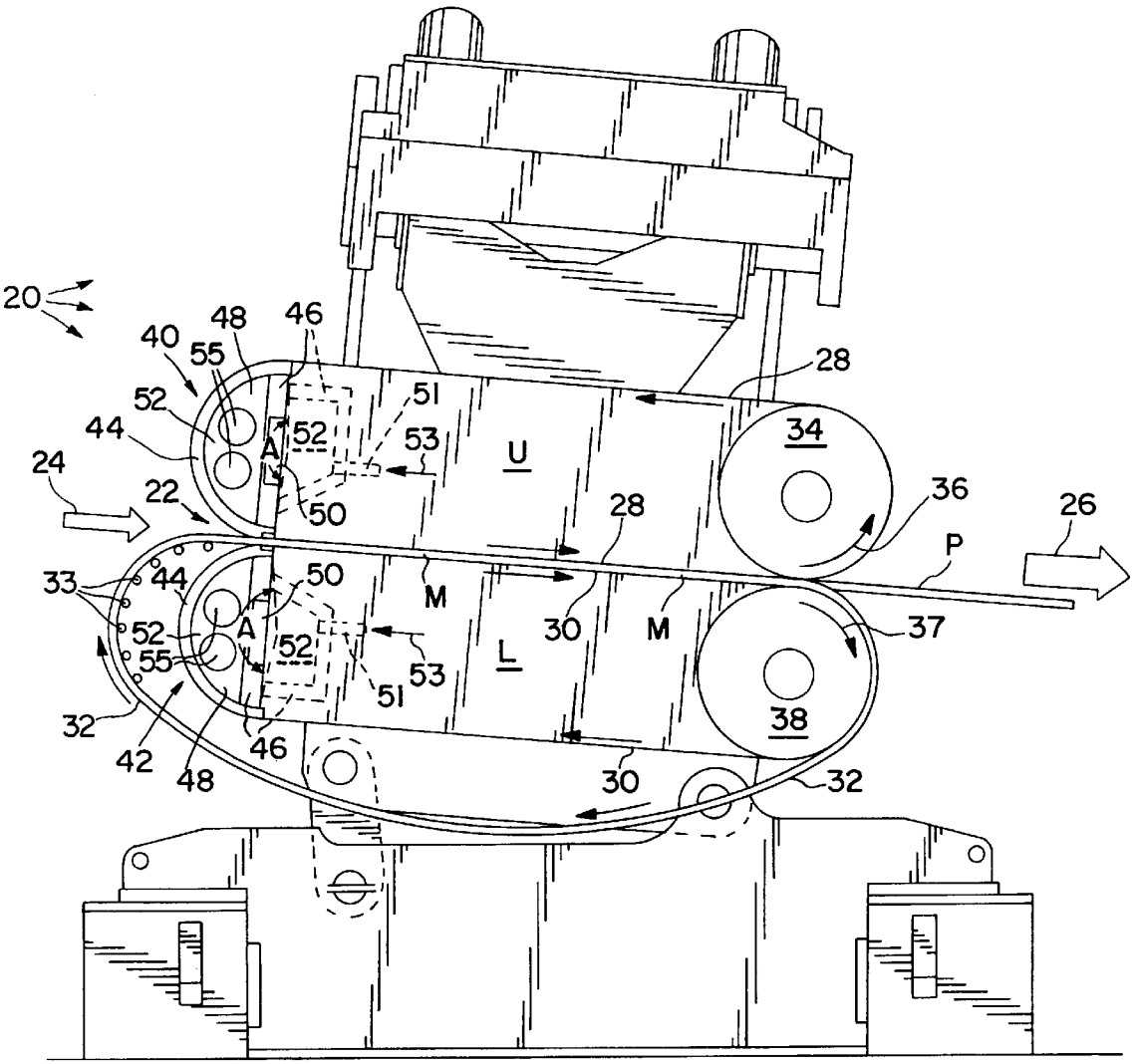
FIG. 1 is a side elevational view of a twin-belt continuous metal-casting machine as seen from its "outboard" side, shown as an illustrative example of a continuous casting machine in which the present invention can be employed to advantage. Air-pillow apparatus embodying the invention is shown in the entrance region in an upper belt carriage and also in a lower belt carriage.

FIG. 1 shows a twin-belt casting machine 20 as seen from its outboard side. The lower and upper carriages are indicated at L and U. Through molten-metal-feeding equipment (not shown) known in the art, molten metal is introduced into the entrance end 22 of the moving mold cavity or mold space M (FIGS. 1, 5, 8, 9). This introduction of molten metal is schematically indicated by a large open arrow 24 shown at the left. A continuously cast product P shown at the right in FIG. 1 emerges (arrow 26) from the exit end of moving mold cavity M.

The lower and upper sides of the moving mold cavity M are bounded by revolving upper and lower endless, flexible, thin-gauge, metallic, heat-conducting casting belts 28 and 30, respectively. These belts are cooled on their inner surfaces by fast-flowing liquid coolant, normally water. The two lateral sides of the moving mold space M are bounded by two revolving edge dams 32 as known in the art. In FIG. 1 an edge dam is shown guided into the entrance 22 by a crescent configuration of rollers 33. Upper belt 28 is driven (as shown by arrow 36) by a rotatably-driven upper exit pulley drum 34 positioned above the exit (downstream) end of the moving mold cavity. Lower belt 30 and edge dams 32 are driven (as shown by arrow 37) by a rotatably-driven lower exit pulley drum 38 positioned below the exit end of moving mold space M. Further information regarding such twin-belt casting machines is set forth in the above-referenced patents of Hazelett et al.

At the entrance end of the casting machine, the upper and lower casting belts 28, 30 revolve respectively around non-rotating, fixed, rigid, convex-curved, cylindrical upper belt-levitating air-pillow apparatus 40 and similar lower air-pillow apparatus 42. Each air-pillow apparatus 40 and 42 includes an air-pillow shell 44, which is a geometric sector of a shell of cylindrical shape. Each shell 44 is perforated with at least one, and in most embodiments of the invention with a multiplicity of, air-jet bore passages 87 in nozzle bodies 85 (FIGS. 5, 8, 9, 10 and 12). The included angle "A" (FIG. 1) spanned (subtended by) by the geometric shell sector 44 is the angle A of guidance of a casting belt. Angle A may be in a range from a few degrees up to about 270 degrees. This shell sector A is shown in FIG. 1 as being about 180 degrees.

Except for corrosion-resistant materials used for coolant transport, air-pillow shells 44 and their stiffening back members 46 (FIGS. 1, 5 and 8) and end walls 48 (FIGS. 2, 3) as shown are made of machinery-steel plate and assembled by welding.

The volume enclosed by sector shell 4-4, stiffening back wall member 46 and end walls 48 comprises a plenum chamber 52 which is used, as will be explained, for distribution 53 of air (gas) as shown in FIGS. 1, 5, 8, 9, 10 and 12. Manual access to this plenum chamber is afforded through access ports in each end wall, which normally are closed by covers 55 (FIGS. 1, 2, 3, 13 and 14). Mounting lugs 50 projecting from opposite ends of the plenum chamber 52 are secured to a strut 47 which stiffens the end wall 48. The term "air" as used herein applies to a gaseous levitating agent and is intended to include ordinary air and fractions of ordinary air such as nitrogen, argon, carbon dioxide, or helium, or any other gas or gaseous mixture that is suitable to use as a levitating agent.

Figure 5:
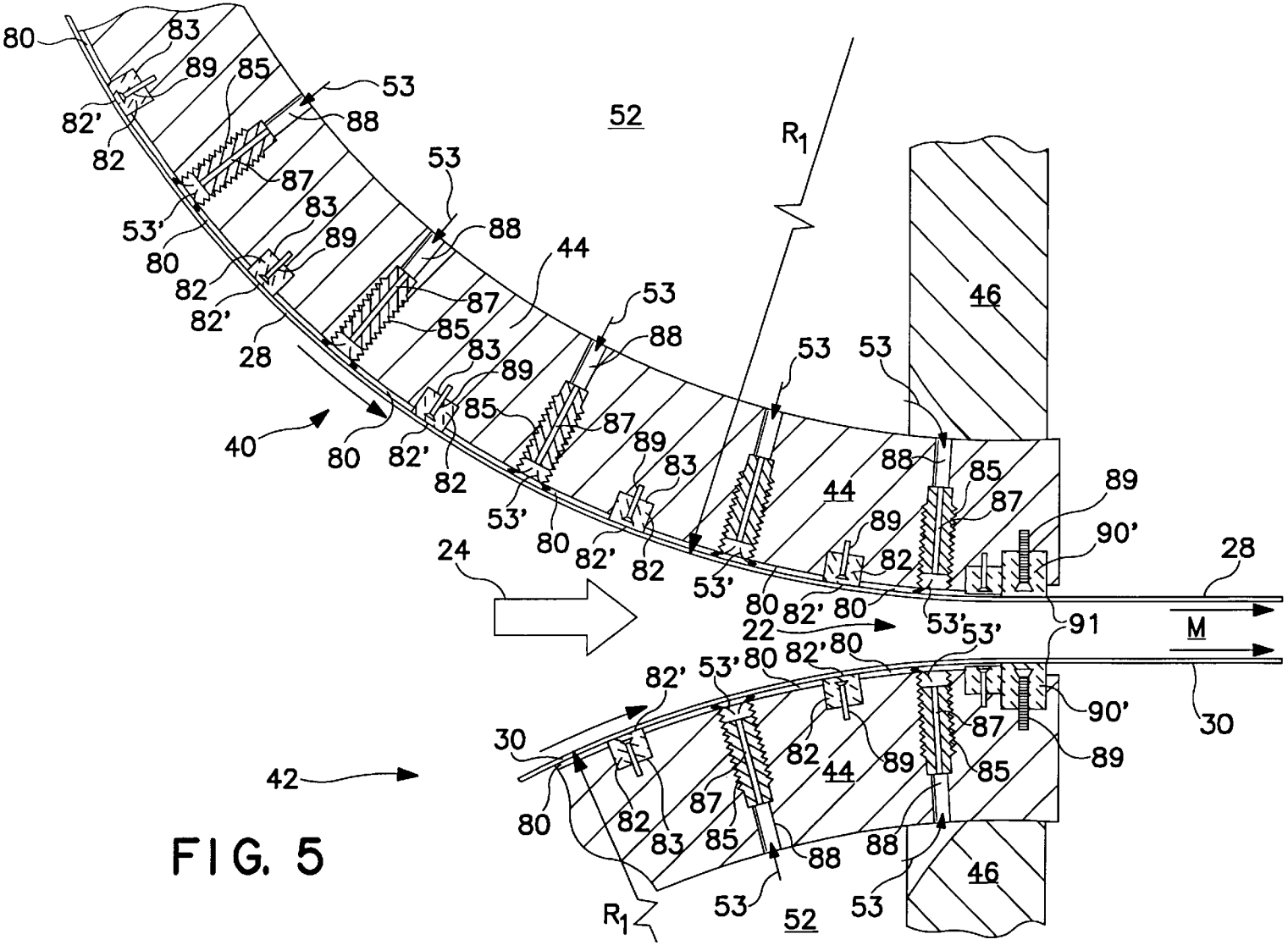
FIG. 5 is an enlarged partial cross-sectional elevational view of upper and lower isolated, depression air-pillow apparatus with their respective moving casting belts in the entrance region of a continuous twin-belt casting machine, such as shown in FIG. 1. The section location of FIG. 5 is indicated at 5—5 in FIG. 4.

In the embodiments of the invention as shown, compressed air 53, 53' is employed as the levitating agent for upper and lower casting belts 28, 30. This levitating agent engages the respective belt as the belt travels along a curved path in wrapped "floating" relationship past the upper or lower air-pillow apparatus 40 or 42. The moving belt is guided in "floating" relationship, being supported by (levitated by) compressed air. Compressed air 53 is fed into the plenum chamber 52 through a suitable pipe or hose connection 51 (FIG. 1). This compressed air passes from the plenum chamber as shown by arrows 53 in FIGS. 5, 8, 9, 10 and 12 into a multiplicity of vestibular passages 88 drilled in shell 44. These passages 88 lead into nozzle bodies 85 having fixedly throttling air-jet bore holes 87 which issue levitating air 53' into controlled levitating relationship with the travelling casting belt 28 or 30. The length of air-jet bore holes 87 in a recent embodiment of the invention is about 19 millimeters. The selection of a suitable diameter of nozzle bores 87 depends on the various embodiments described later, and is in a range from about 0.4 millimeter to 15 millimeters. The diameter of jet-nozzle bore holes 87 in the embodiment shown in FIG. 5 is 1.15 millimeters.

Figure 7:
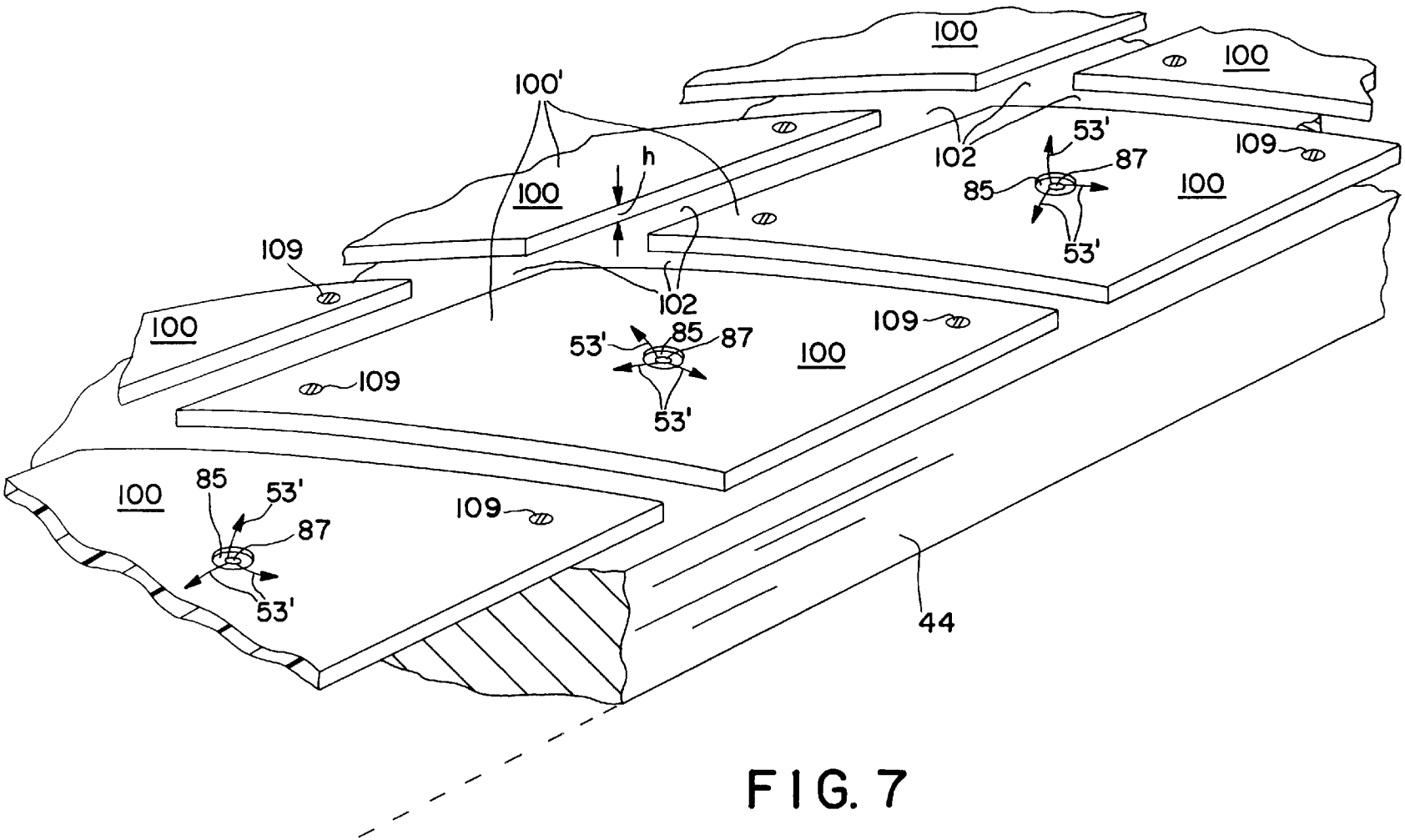
FIG. 7 is similar to FIG. 6, but FIG. 7 shows a portion of isolated-plateau air-pillow apparatus.
Figure 8:
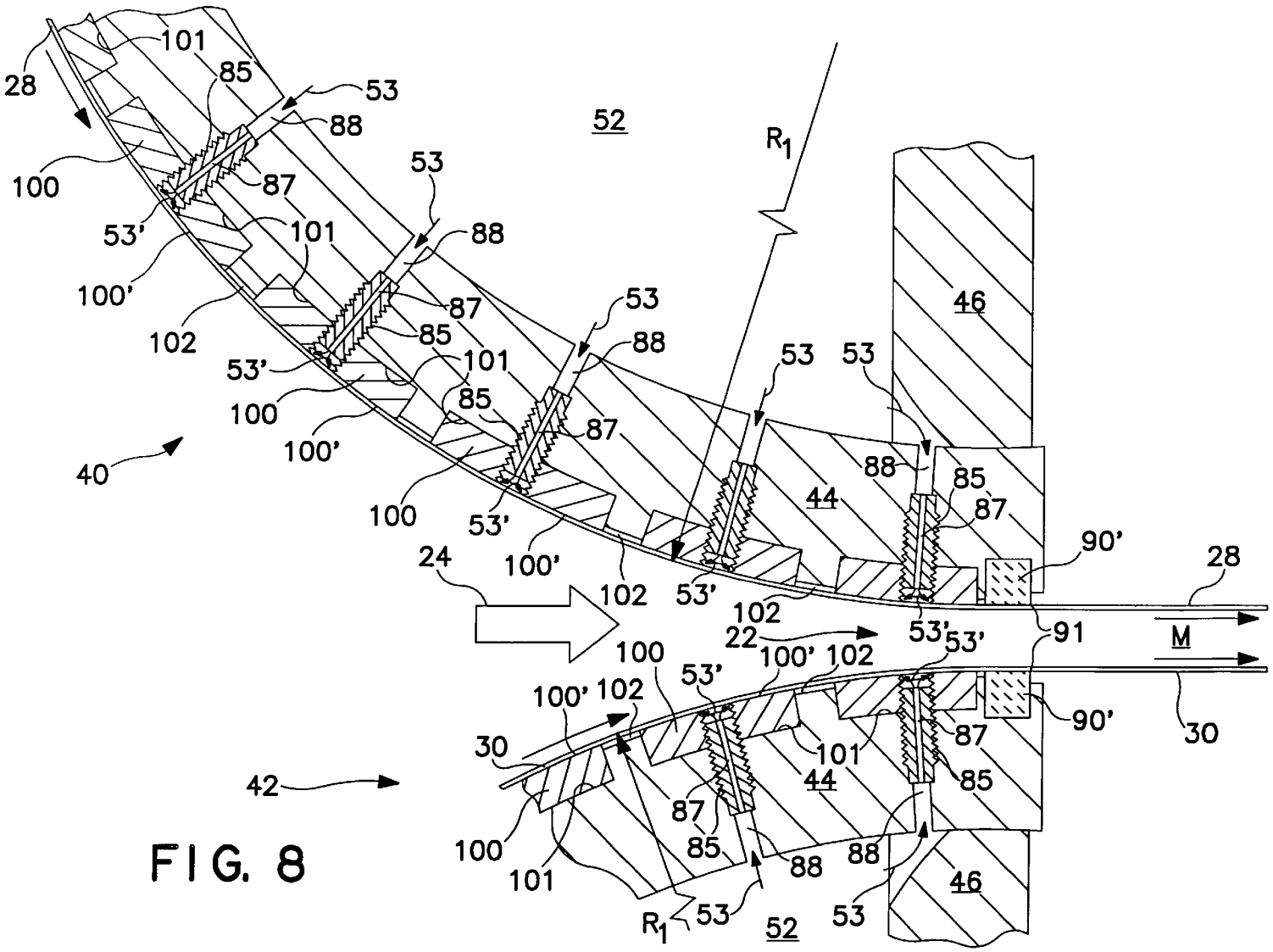
FIG. 8 is similar to FIG. 5, but FIG. 8 shows upper and lower isolated-plateau air-pillow apparatus with their respective moving belts.

All reference to air pressure henceforth is to "gauge pressure," i.e., pressure in relation to atmospheric pressure taken as zero. The pressure of compressed air 53 supplied into plenum chamber 52 via air inlet 51 (FIG. 1) is about 850 kilopascals or about 8.5 bars, which approximates about 120 to 130 pounds per square inch (psi), commonly available in industrial plants. After air flow 53 has passed through vestibules 88 and through the throttling air-jet bore holes 87, the resultant belt-levitating air 53' in a belt-levitating region located between air-pillow shell 44 and the concave, cylindrically curved inner surface of the traveling levitated casting belt 28 or 32 has an average pressure, for example, of about 425 kilopascals or about 4.25 bars (about 60 to 65 psi), as will be explained presently. As shown in FIGS. 2 through 6, 9 and 12, air-jet bore holes 87 feed levitating air 53' into the center of each shallow depression 80. As shown in FIGS. 7, 8 and 10, the air-jet bore holes 87 feed levitating air 53' spreading out from the center of each elevated plateau 100. A thickness of the endless casting belts 28 and 32 as shown herein is about 1.2 millimeters (about 0.046 to about 0.048 of an inch).

Air-pillow shells 44, as shown in FIG. 1 have a radius $R_1$ (FIGS. 5, 8 arid 9) of about 305 millimeters (mm), (about 12 inches), and each shell 44 spans (subtends) an included angle A (FIG. 1) of about 180°. Using air pillow apparatus of 610 millimeters diameter in a machine for example such as shown in FIG. 1, the force exerted against each of two reaches of each casting belt by the levitating air 53' of the air pillow apparatus 40 or 42 in a direction parallel to the mold M, i.e. parallel to freezing product P, is about 125 newtons per millimeter of belt width. This force results in a tensile stress of about 10,000 newtons per square centimeter of cross section in the casting belt 28 or 30. This tensile stress approximates the operating practice of the prior art.

The force exerted by pressure of levitating air 53' where it contacts the curved inner surfaces of casting belts 28, 30 normally is adjusted to provide a total upstream-directed force component that is slightly less than, or equal to, the effective total tensile forces exerted in a downstream direction by the belt 28 or 30 acting upon its respective air pillow apparatus 40 or 42. This is to say, this total upstream-directed force component is preferably between about 99 and 100 percent of the effective total belt tensile forces or, at a minimum, 90 percent. As a result, the casting belt 28, 30 may slide against the air pillow shells 44 though lightly. The contact of the travelling casting belt against the convex peripheral belt-guiding surfaces of an air pillow shell is nearly or entirely eliminated. By maintaining some slight sliding contact as at semi-seals, such as perimetral seals 90 and 90' in FIGS. 4, 5 and 8 or at a seal 82 in FIG. 9, any significant unstable movements of the casting belt in any direction can be prevented. It is to be understood that, during continuous casting operation, the pressure of levitating air 53' may be adjusted slightly upwardly so as to minimize wearing of the working surface against the inner surface of the moving belt and may be adjusted slightly downward so as to diminish any incipient unstable movements of vibrations or noises. The terms "levitate" or "levitating" or "levitated" herein include this situation wherein friction is relieved but some light contact and slight friction remain.

I have found that the air-pillow apparatuses described permit quiet operation of travelling curved flexible casting belts operating under tensile stress approximating customary practices of the prior art.

Isolated Depression Embodiments: The invention is embodied basically in two complementary modes. Embodiments of the first mode employ an array of a multiplicity of broad, isolated, semi-sealed, shallow depressions 80 formed on the convex exterior surface of cylindrically shaped air pillow shell 44 (FIGS. 2 to 6, 9). These shallow depressions 80 constitute a major portion of the total belt-levitating area of air-pillow shell 44. Shallow depressions as shown have a rectangular configuration which is almost square. These shallow depressions 80 are shown bounded and defined by a semi-sealing grid, i.e. Anon air-throttling barrier grid 82 as shown in FIGS. 2 to 6 and 9. If this cylindrically shaped grid were laid flat, it would be a rectangular grid. The outward surface of grid 82 provides belt-supporting, belt-path-guiding, convex peripheral working surfaces (faces) 82' (FIGS. 5 and 12) of the cylindrically shaped air-pillow shell 44. The grid 82 as shown may be described generally as defining and constituting an array of air-throttling surfaces (faces) 82' circumscribing a plurality of rectangular levitating shallow depressions.

Figure 2:
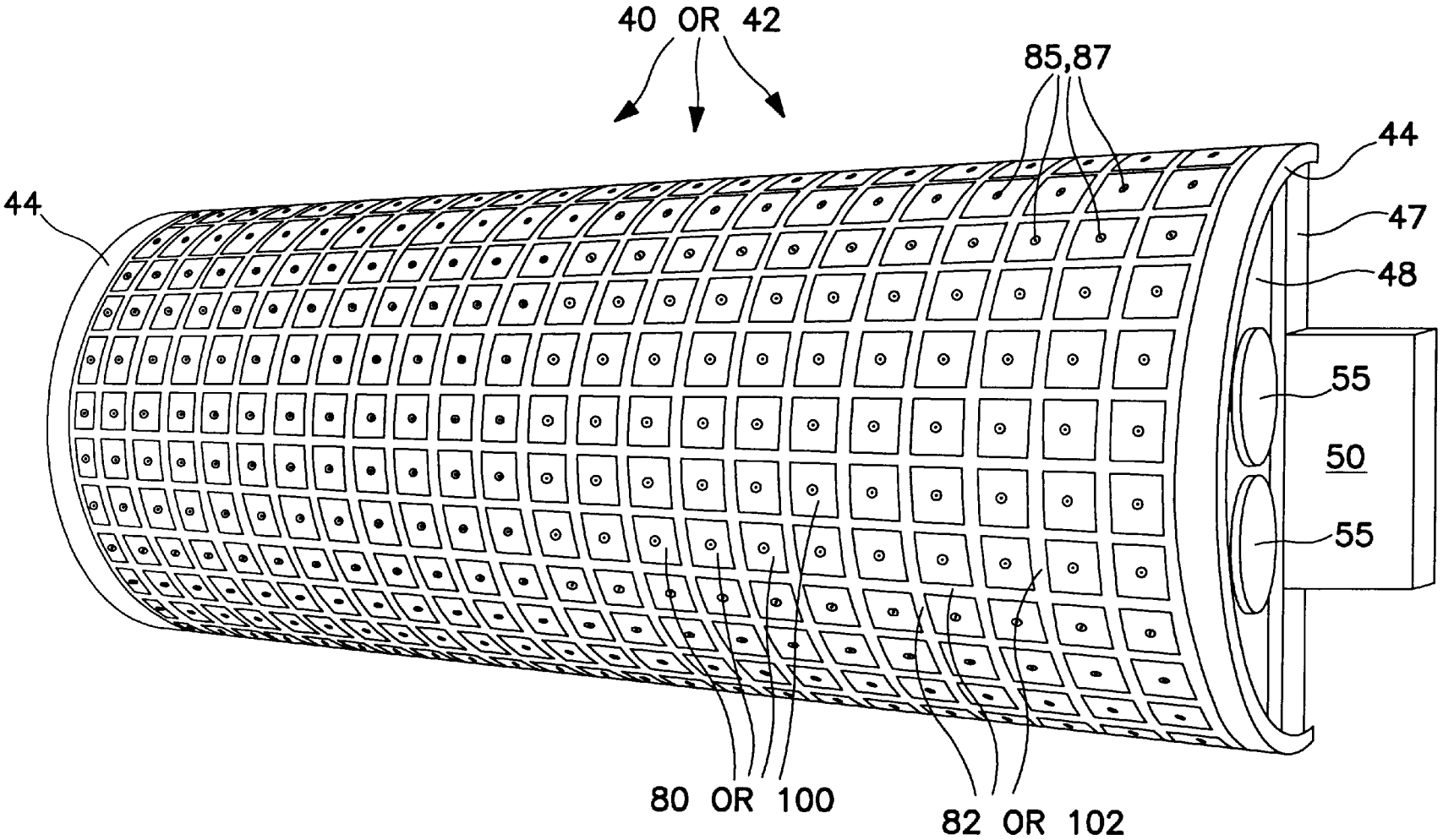
FIG. 2 is a perspective elevational view of isolated-depression air-pillow apparatus as seen looking downstream. The air-pillow apparatus is shown in the orientation it has in FIG. 1 wherein this apparatus is mounted in an entrance region of an upper or lower belt carriage.
Figure 3:
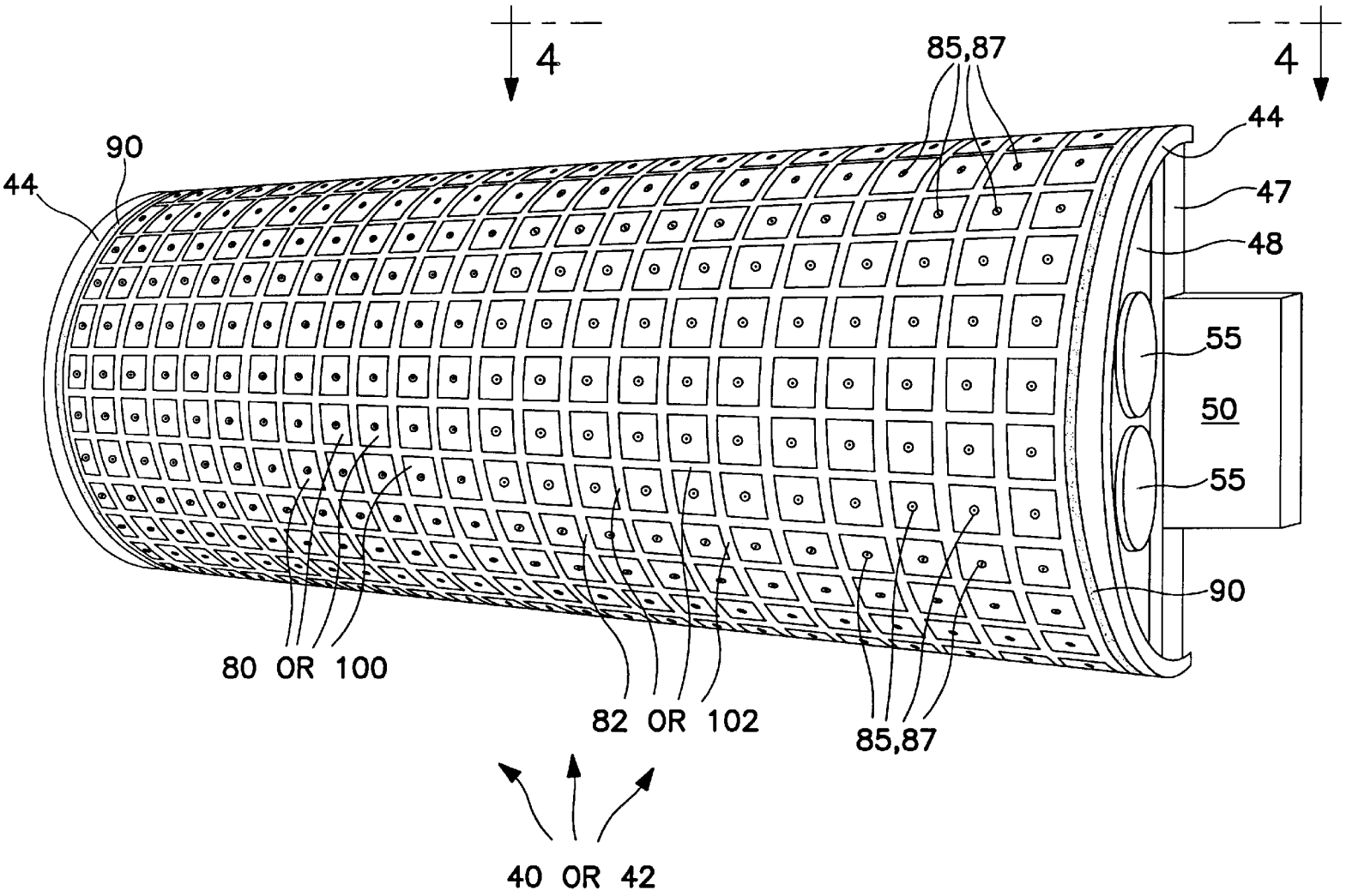
FIG. 3 is a view similar to FIG. 2, but FIG. 3 shows isolated-depression air-pillow apparatus having perimetral air-throttling barriers.
Figure 4:
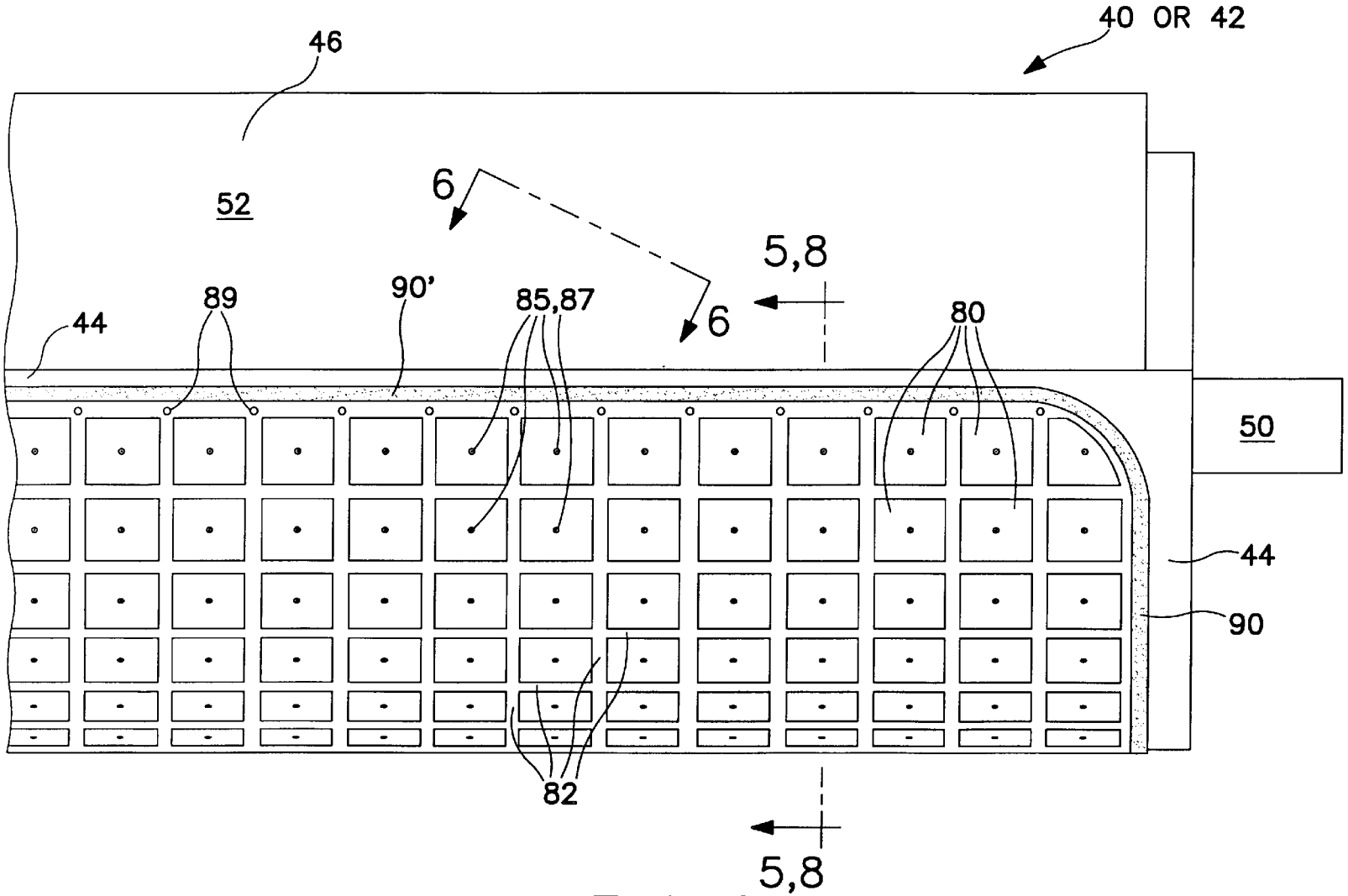
FIG. 4 is an enlarged view of an end portion of the isolated-depression air-pillow apparatus as seen looking down from position 4—4 in FIG. 3.
Figure 9:
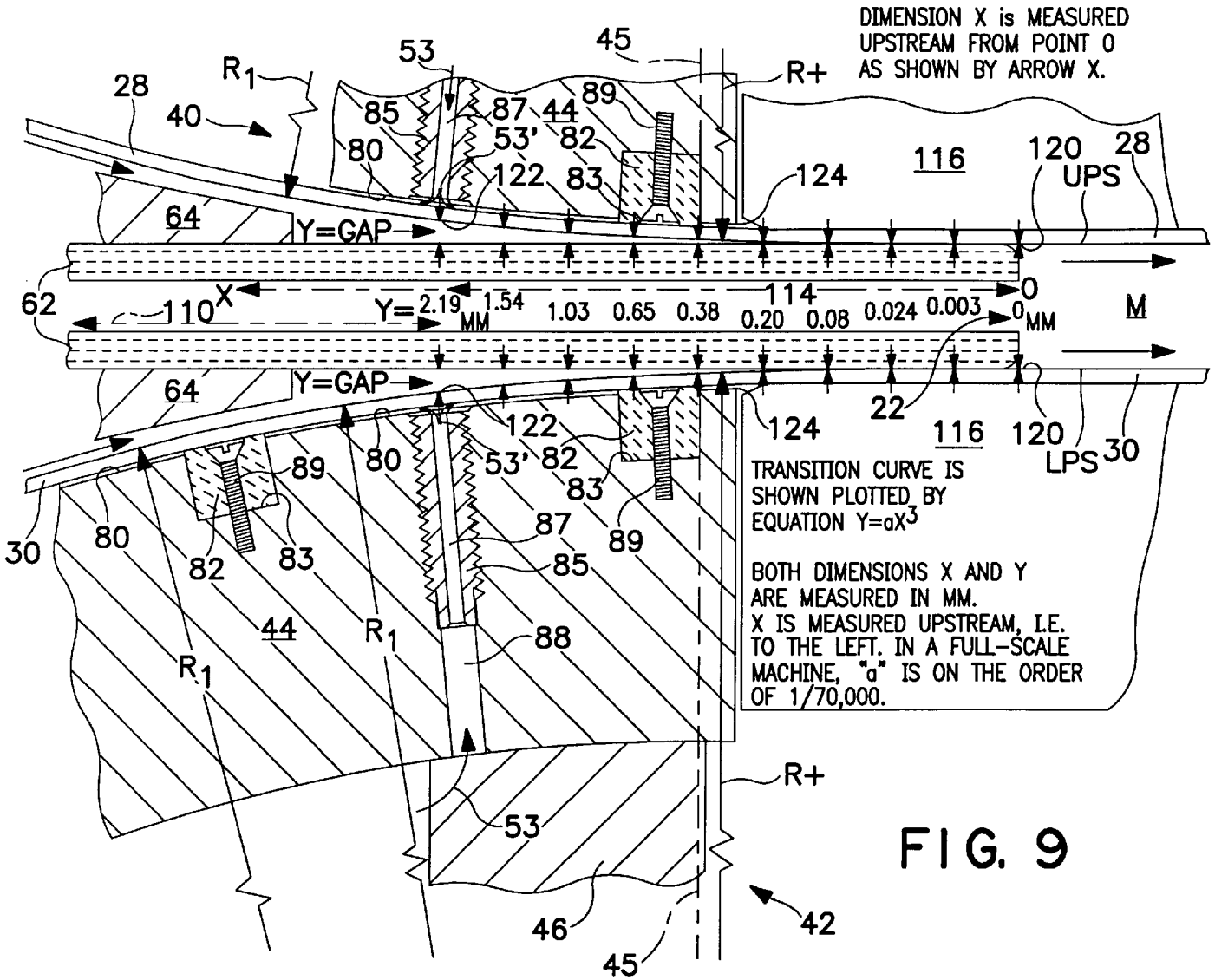
FIG. 9 is a further enlargement of the entrance region shown in FIG. 5.
Figure 10:
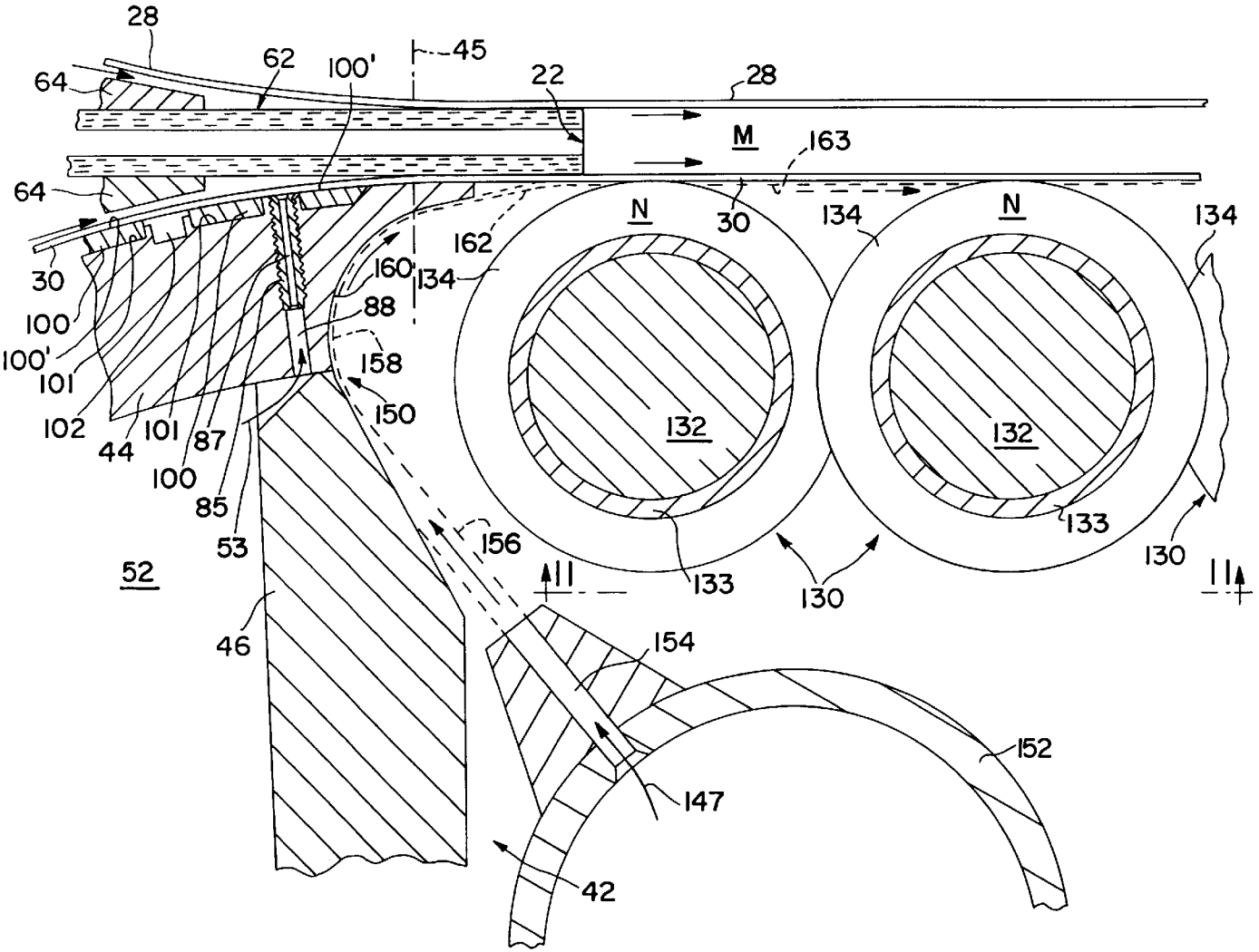
FIG. 10 is an enlarged partial cross-sectional view showing a curved deflector which redirects an initial high-velocity flow of liquid coolant for applying it flowing downstream along the lower belt.

When enwrapped by a casting belt as shown in FIGS. 1, 5 and 9, the grid 82 and the concave, cylindrically-curved inner belt surface define shallow cavities 80 depressed below the peripheral working surfaces 82' of semi-cylindrical air-pillow shell 44. The grid 82 and its convex working peripheral surfaces 82' can be made integral with air-pillow shell 44 (FIGS. 2, 3, and 4).

In a preferred construction, however, the grid 82 is formed of flexible material, for example such as slippery plastic material which is removably attached to air-pillow shell 44. This grid 82 is formed either as a monolithic net of elongate elements, this net being cut or stamped from a sheet of suitable slippery plastic material or, alternatively, the grid 82 is formed by assembling a multiplicity of separate, elongated strips of suitable plastic material. Whether the grid 82 is monolithic or is assembled from multiple strips, the flexible material of which it is formed preferably is durably wear-resistant when subjected to continual sliding contact of a moving casting belt 28 or 30. The currently preferred slippery plastic material for constituting grid 82 is PTFE (polytetrafluoroethylene), marketed by DuPont under their trademark "Teflon."

The monolithic grid or individual strips 82 preferably fit (nest) into closely conforming grooves 83 machined in the outer surface of each air-pillow shell 44. Capture of the grid 82 nested in grooves 83 is completed by screws 89 (FIGS. 5, 6 and 9) and by the enwrapping relationship of a casting belt as shown in FIGS. 1, 5 and 9. The depth of grooves 83 is such that peripheral working surfaces 82' (FIGS. 5 and 12) of a monolithic grid 82 (or equivalent assemblage of individual strips) are elevated above the floor of each thus-formed isolated, levitating semi-sealed shallow depression 80 by a small radial elevation "h" (FIG. 6) in a range between about 25 microns and 2.5 millimeters. This radial protrusion dimension "h" establishes the resulting assembled depth of each shallow depression 80.

When the shell 44 is machined as an integral construction of shell 44 together with its semi-seals provided by air-throttling grid 82, then dimension h is the height from the floor of each shallow machined depression 80 to the belt-guiding, peripheral working surfaces 82' of this integral grid. FIG. 2 is intended to illustrate an integral construction of grid 82 and shell 44, and also to illustrate a grid 82 formed by a net (or by individual strips) assembled in nested relationship in grooves (not seen in FIG. 2) in the shell 44.

The working surfaces 82' of grid 82 acting in conjunction with the inner surface of a travelling casting belt provide a network of air-throttling paths (semi-sealing paths) for the escape of pressurized belt-levitating air 53' from each shallow depression 80. This escape of belt-levitating air 53' from the shallow levitating depressions 80 advantageously serves for isolating pressure in each depression from pressures in neighboring depressions, because escaping air flows toward regions of lower pressure and avoids regions of higher pressure. Consequently, each levitating depression 80 acts as an isolated, belt-levitating area operating somewhat independently of the other isolated depressions 80, thereby avoiding positive feedback effects between air pressures in neighboring belt-levitating areas, and thereby avoiding generation of screeching noises and belt vibrations.

The combined totality of a resulting multiplicity of individual, somewhat independent, somewhat isolated, belt-levitating forces (applied to the inner surface of an overlying moving belt wrapped around an air-pillow shell 44) created by pressure of levitating air 53' in the multiplicity of shallow depressions 80 provides a substantially uniform upstream-directed levitating-air force on a moving belt, which (as is explained above) is at least about 90 percent of the total effective tensile forces in the associated revolving belt, with minor remaining upstream force, if any, on a moving belt being provided by some slight mechanical contact between a moving belt and portions of air-pillow apparatus.

An individual air-jet bore 87 is shown communicating with the center of the floor of each shallow depression 80 for feeding belt-levitating air 53' into the depression. As explained above, each shallow depression is semi-sealed by the inner surface of the belt enwrapped around the air-pillow shell 44 and whose inner surface is very closely adjacent to or is lightly sliding against working surfaces 82'. Pressurized belt-levitating air is continually escaping, i.e., exhausting, into the atmosphere by flowing over and along the working surfaces 82' of grid 82 (FIGS. 5, 6, 9 and 12).

Isolated Plateau Embodiments: Second-mode embodiments of the invention have an array of broad, isolated, air-throttling, levitating "plateaus" 100 (FIGS. 7 and 8, also 10) positioned on the exterior of air-pillow shell 44. Isolated plateaus 100 are defined and bounded by grooves (channels) 102 which provide air-escape (air-exhaust) pathways. In an overall, generalized view, the second-mode embodiments have reverse radial relationships as compared with the radial relationships of the first-mode embodiments as seen by comparing FIGS. 7, 8 and 10 with FIGS. 5, 6, 9 and 12.

Isolated rectangular plateaus 100 have convex peripheral surfaces (faces) 100'. These surfaces 100' are belt-supporting, guiding, convex peripheral working faces of the cylindrically shaped air-pillow shell 44 (FIGS. 7, 8 and 10).

The plateaus 100 and their working surfaces 100' can be made integral with air-pillow shell 44 as shown in FIG. 7, except that in an integral construction there are no screws 109. In a preferred construction, however, the individual plateaus 100 are formed of flexible material, for example such as plastic material that is durably wear-resistant when subjected to continual contact of a moving casting belt 28 or 30, for example such as the currently preferred slippery plastic material described above. These individual rectangular plateaus 100 preferably fit (nest) into closely conforming rectangular depressions 101 (FIGS. 8 and 10) formed in the outer surface of each air-pillow shell 44. Capture of individual plateaus. 100 nested in their depressions 101 is completed by screws 109 (FIG. 7) and by the enwrapping relationship of a casting belt as shown in FIGS. 1, 8 and 10.

Levitating air 53' is shown issuing from the center of each working surface 100', being fed by means of a nozzle body 85 (FIGS. 8, 10) having an air-jet bore hole 87. Plateau working surfaces 100' are shown arranged in a rectangular array. These working surfaces serve both the functions of providing belt-levitating areas for supporting belt-levitating pressurized air 53', and also they provide a semi-sealing function, acting in association with the inner surface of an overlying belt, i.e., an air-flow throttling function. Each plateaued working surface 100' provides a semi-seal acting against the moving inner surface of the overlying casting belt 28 or 30. Thus, the levitating air 53' issues from each air-jet bore hole 87 and escapes as a very thin film flowing outwardly over each working surface 100' from the centralized air jet. The outwardly-flowing belt-levitating air 53' endures speed-induced frictional pressure loss; i.e. it is throttled as it flows outwardly over each surface 100', and this escaping air slips into the system or network of air-exhaust grooves 102, whence the escaping air returns to the atmosphere when it reaches the edges of the air-pillow shells 44. Isolated-plateau embodiments of the invention work well only when the belt is quite free from irregularities of surface shape or flatness.

Both the embodiments of the first mode of the invention, which includes isolated shallow depressions 80, and the embodiments of the second mode of the invention, which includes isolated plateaus 100, may be characterized together as arrays of isolated belt-levitating areas with intervening air-escape paths.

Embodiments Having Transition Curves: In FIGS. 5 and 8, the radius $R_1$ is shown to be the radius of peripheral working surfaces 82' and 100' of respective air-pillow shells 44 having isolated depressions 80 and isolated plateaus 100. Thus, these working surfaces 82' and 100' conform with a circular cylindrical surface, and so they simulate the upstream halt of the exterior surface of a rotating pulley drum. Points 91 in FIGS. 5 and 8 at the entrance 22 of the moving mold M are located at the downstream edges of perimetral seals 90'. These points 91 are tangent points whereat moving belts 28 and 30 theoretically become bent (flexed) from circular cylindrical to straight planar configuration travelling in spaced parallel-relationship, defining moving mold M between them.

Given the available constraints upon a casting belt of normal thickness and springiness, such an abrupt flexing of a belt from the circular cylindrical configuration of the peripheral working surface of an air-pillow shell 44 to a straight planar configuration does not in fact occur. The undesirable result is an indeterminate path for the casting belt and the consequent unsteady or lapsed contact of the freezing product against the casting belt, thereby permitting undesirable surface liquation and alloy segregation.

When casting belts 28, 30 of normal and greater thickness are employed, a locally variable radius R+ (FIG. 9) of the casting belt as defined by its guides is advantageously progressively increased above $R_1$ in a flexural transition region 114 where the moving casting belt approaches and enters the mold space M. This region 114 of transitional radius R+ extends downstream from points 122 to mold entrance points 120. In this transitional region, the curvature 1/R+ (the reciprocal of the local radius) of each belt is advantageously progressively decreased in a tapering relationship decreasing all the way down to zero at a transitional tangent point 120 (FIG. 9) at the mold entrance, where the two belts become straight, travelling in spaced parallel planes. The need for this tapering-off (progressive decrease) of curvature arises from the elastic stiffness or springiness of casting belts of suitably high thickness, a stiffness which otherwise would distort the belt path where the belt leaves the downstream end 91 (FIGS. 5 and 8) and 124 (FIG. 9) of an air pillow shell 44.

The tapering-off of curvature in FIG. 9 begins at points 122 in this magnified cross-sectional view and continues to mold-entrance points 120. Downstream, past a centerline 45 (FIG. 9) of the major part of each air pillow apparatus, the belt 28 or 30 is guided into the mold space M by stationary elements 116 as disclosed and claimed in PCT application WO 98/01247 of Kagan et al., which application is assigned to the same assignee as the present invention. There are multiple, spaced, parallel elements 116 magnetized by reach-out permanent magnets providing magnetic attraction acting in opposition to hydrodynamic belt-levitating forces for providing belt guidance and stabilization.

The belt-path curvature 1/R+ gradually decreases from points 122 to points 120, becoming zero at the casting belts' tangent points 120. Downstream from tangent point 120, the belts are constrained to be straight, travelling in spaced parallel planes. (Note that the multiple-radii cross-sectional shape of an air pillow shell with a progressively increasing radius R+ in transitional region 114 is still a "cylinder" and a "cylindrical surface"; see for instance *Merriam-Webster's Collegiate Dictionary*, tenth edition [1993]).

An ideal, gradually straightening curved casting-belt path 114 plotted in FIG. 9 between points 120 and points 122 follows the formula: $y=ax^3$ as in a railway transitional curve, where "a" in a full-scale casting machine is on the order of 1/70,000. Both dimension x and dimension y are measured in millimeters. x is measured to the left, i.e., in an upstream direction from new tangent points 120. The successive number values for dimension y are shown for convenience printed within the passage space of a metal-feeding nozzle 62 supported between clamps 64. These y dimensions apply separately to each of the two belts—upward for the upper belt 28 from the upper surface of nozzle 62 (which aligns with the plane of the planar mold surface of upper belt 28) and downward for the lower belt 30 from the lower surface of this nozzle (which aligns with the plane of the planar mold surface of lower belt 30).

Magnetic attraction force from elements 116 is usefully applied in guidance of a moving casting belt in the critical areas 114 of reducing curvature, since the wrapping pressure on the levitating air pillow shell 44 provided by tension of the casting belt in this region 114 of reduced curvature is naturally less than the wrapping pressure acting on the major portion 110 of the air pillow apparatus where the radius is a constant $R_1$.

Since the tapering-off of curvature of the casting belts is gradual along the transitional region 114, the elastic bending spring force likewise tapers off gradually. Thereby, advantageously, the respective casting-belt paths are under determinate control throughout their travel past the nozzle 62 and into the mold M; the springiness of the belt does not deflect either belt from its intended guidance path.

Instead of a railway transitional curve, such as $y=ax^3$, a sequence of smooth curves of decreasing curvature may be used in less critical applications.

FIGS. 3–5, 8, 13 and 14 show embodiments of the invention wherein there is employed an elongate perimetral air-throttling seal 90, or 90', which is a little higher above the convex peripheral working face than the other air-throttling or supporting surfaces. Such a perimetral seal holds a minimal air pressure (above atmospheric) over the entire convex face of the air-pillow shell 44. Throttled air finally escapes to the atmosphere past this semi-seal 90, 90' at the perimeter of each air pillow shell in apparatus 40 or 42. The upper and lower horizontal courses 90' of these perimetral air-throttling seals 90 assist in controlling the path of the casting belt 28 or 30 where they enter upon and leave the air-pillow shell 44, defining for such shells of circular cylindrical shape theoretical belt-flexure tangent points 91. A suitable material for semi-seals 90 is polyamide (nylon) in the form of bunched and twisted strands, which is commercially available as strip-packing material. Other suitable wear-resistant, relatively flexible slippery material may be used.

Figure 6:
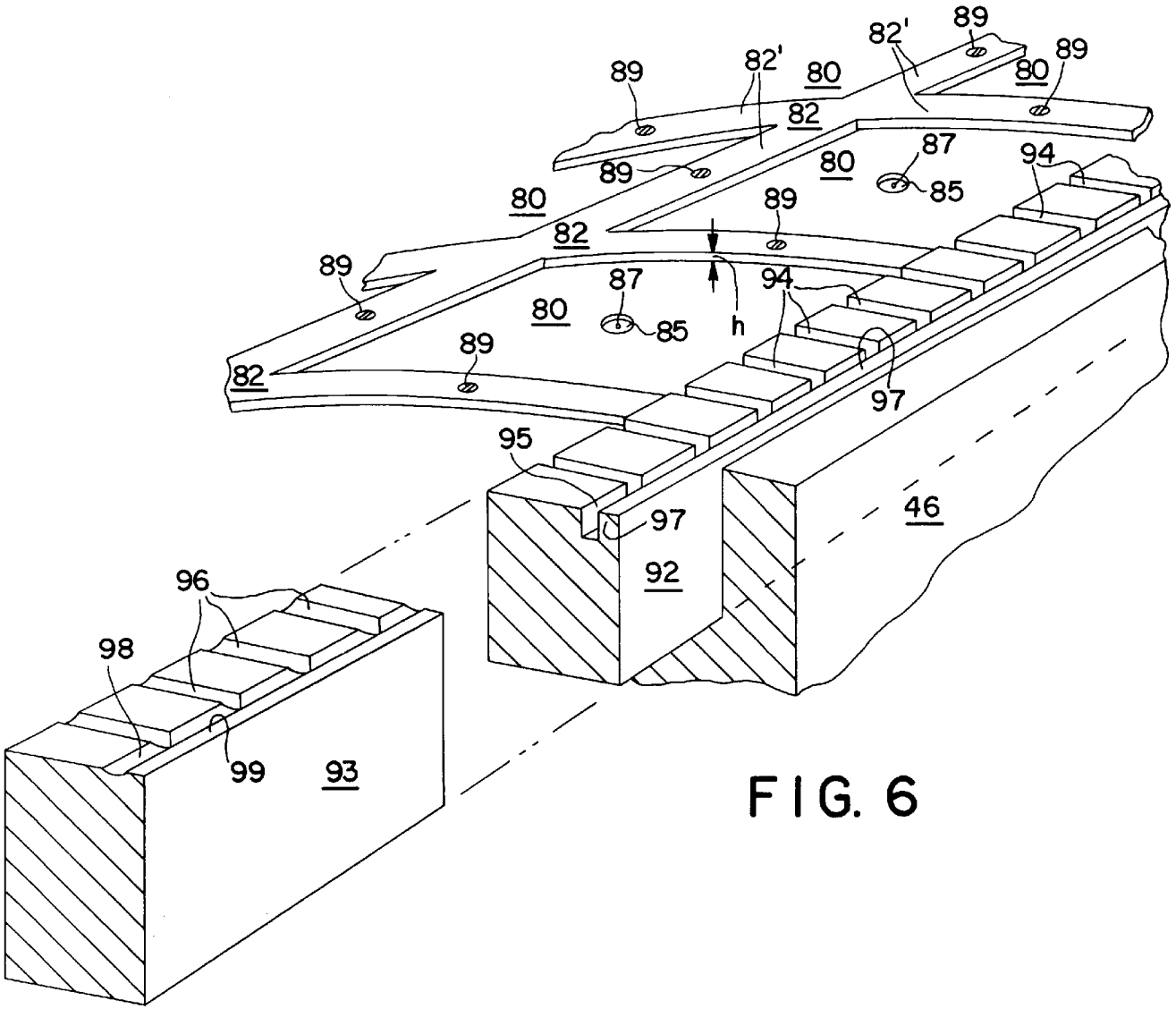
FIG. 6 is a greatly enlarged partial perspective and sectional view of a portion of isolated-depression air-pillow apparatus as seen generally from position 6—6 in FIG. 4, looking diagonally upstream from an elevated viewing position. Two embodiments are shown of fine pressure-extension grooves in an outward face of a perimetral seal.

FIG. 6 shows in perspective a pattern or "tread" of shallow fine friction-reducing grooves 94 and 95 of rectangular cross section cut or impressed into the outward surface, the working surface of a modified perimetral seal 92. Such a modified seal 92 may be used in place of plain nylon air-throttling seal 90. Grooves 94 oriented parallel with belt motion communicate with a deeper transverse groove 95 extending adjacent to a perimetral air-throttling lip 97. These grooves 94 and 95 spread the pressure of the confined pressurized levitating air 53' over much of the face of the seal 92, thereby reducing friction between this seal and the moving casting belt 28 or 30, and rendering contact with the casting belt more uniform.

At the lower left of FIG. 6 is shown a perimetral air-throttling seal 93 whose working surface has another pattern or "tread" of friction-reducing grooves 96 and 98. Instead of the rectangular-shaped grooves 94 and 95 of seal 92, the grooves 96 and 98 have a shallow scalloped shape. Shallow transverse groove 98 extends adjacent to a perimetral lip 99.

The perimetral seal 90 is advantageously used in connection with the first and second modes of embodiment of the invention, described above. The employment of the perimetral seal 90 also enables realization of a third mode of embodiment of the invention, namely, the merging of isolated depressions into, at the limit, a parallel array of shallow circumferential channels 86 (FIG. 13) which are isolated from each other by intervening parallel circumferential ridge strips 81 formed of slippery belt-supporting material similar to that which forms grid 82. Working surfaces 81' of these circumferentially oriented ridge strips 81 do not provide significant air-throttling action. To protect the tensed casting belt from significant local transverse sagging (scalloping) or bending, such strips 81 are continuous in a circumferential direction in the array shown in FIG. 13 (wherein only portions of the perimetral seal 90 are seen) Each circumferential channel 86 is individually fed with pressurized belt-levitating air 53' by a centrally located nozzle body 85 having an intermediate-sized diameter air jet 87'.

Figure 13:
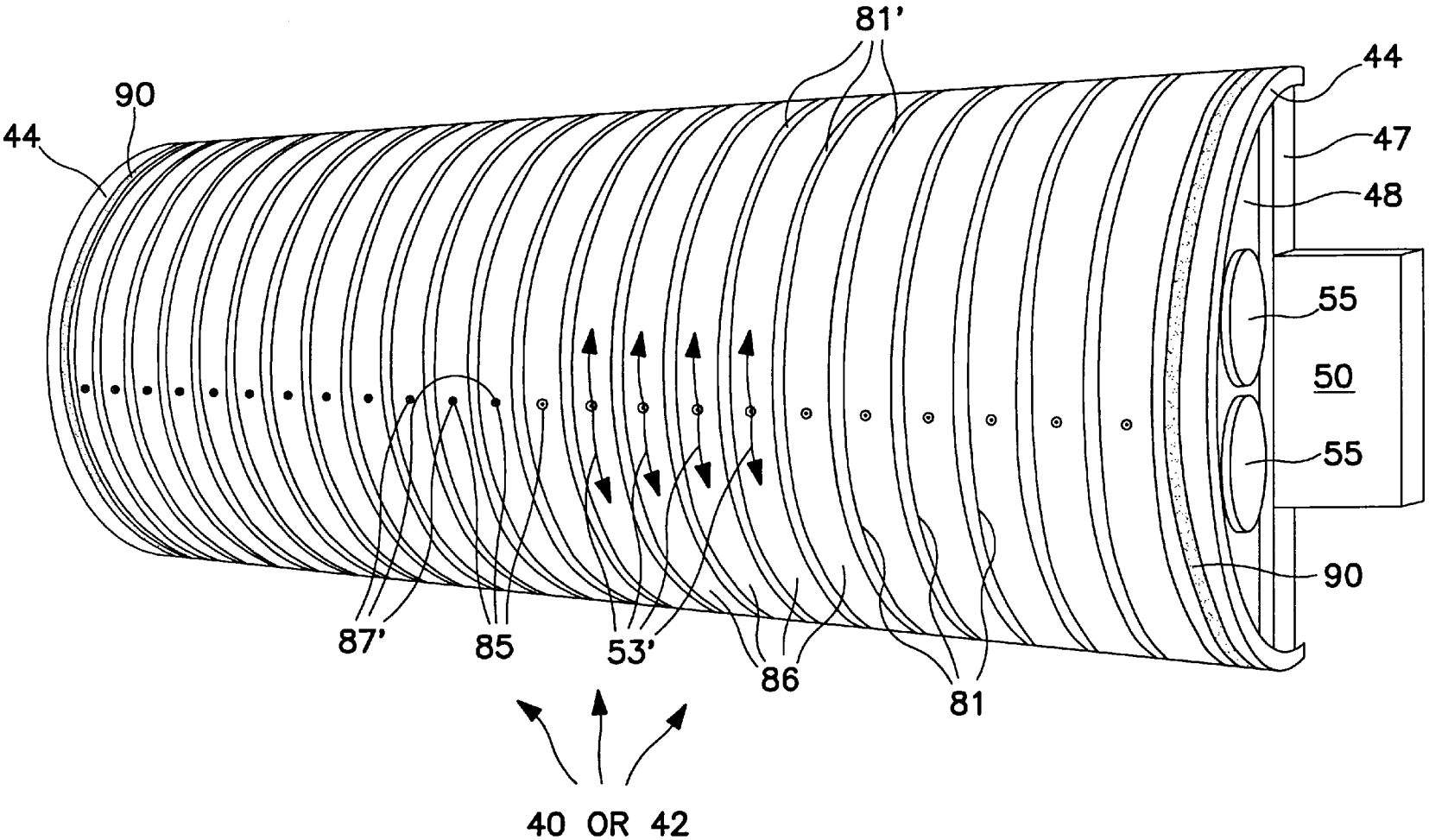
FIG. 13 is a view similar to FIG. 3, except that this modification has the isolated depressions configured as elongated semi-circular depressions extending parallel to the direction of belt travel.
Figure 14:
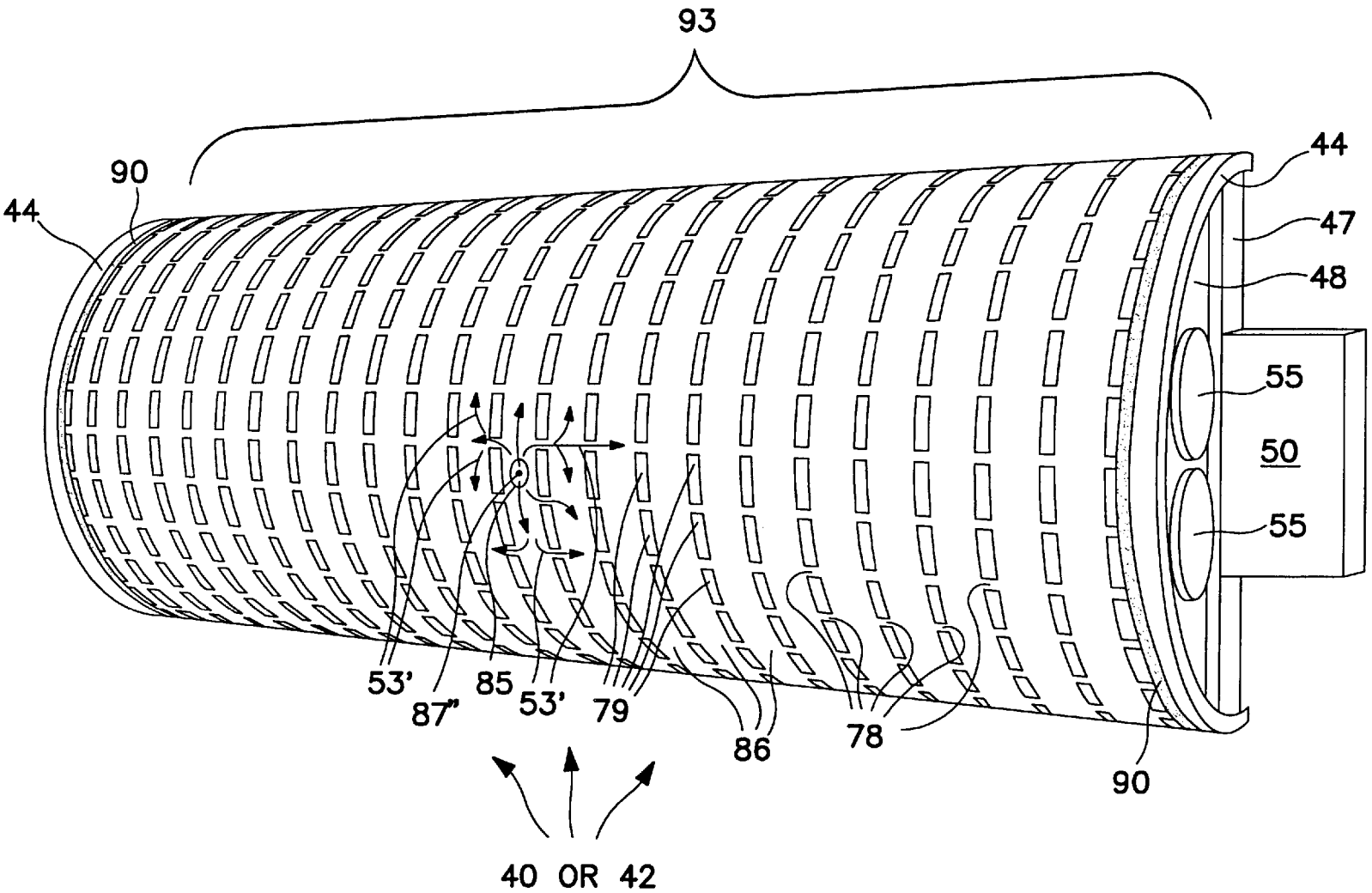
FIG. 14 is a view similar to FIG. 13, except that in this modification one air-jet feeds into one unified levitating area for the entire air pillow apparatus.

In FIG. 14 one large nozzle body 85 having a very large diameter air jet 87", centrally located, covers with pressurized levitating air 53' the whole outer surface of a shell 44 within the perimetral seal 90. However, to use only one such central large air jet 87', air-throttling action over the working surfaces 81' of ridge strips 81 (FIG. 13) must be substantially prevented, lest lowered levitation occur toward the inboard and outboard ends of the air-pillow shell 44. To avoid such throttling by working surfaces 81' (FIG. 13), the ridge strips are interrupted with numerous transverse gaps 78 (FIG. 14) having a circumferential length of less than about 2 degrees (less than about 9 to 10 millimeters), thereby providing numerous island ridge strips 79 for transversely distributing levitating air 53' without significant pressure drop to all circumferential channels 86 within the peripheral seal 90. Thereby is provided a single interconnected unified belt-levitating area 93 encompassing the whole exterior surface of a shell 44 within its perimetral seal 90.

Whatever the configuration in FIGS. 13 or 14, pulling or sagging of the tensed belt into the circumferential channels 86 must be minimized. To this end, these channels 86 are to be no wider than about 150 times the thickness of the casting belt being used.

Figure 11:
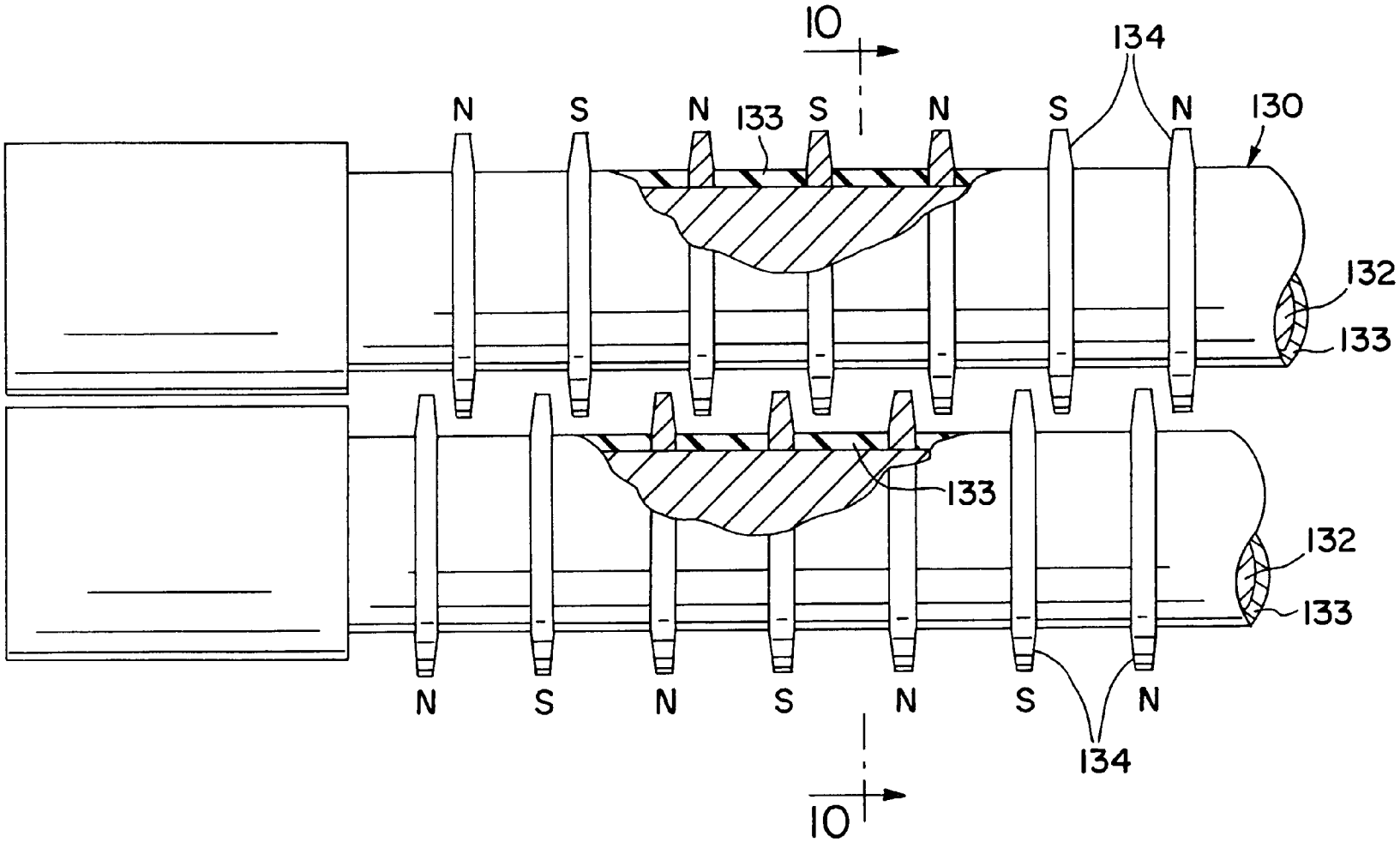
FIG. 11 is a view of nested backup rollers as seen from position 11—11 in FIGS. 10 and 12. These nested backup rollers have magnetized fins with alternate N, S, N, S polarities, as disclosed and claimed in U.S. Pat. No. 5,728,036 referenced above.
Figure 12:
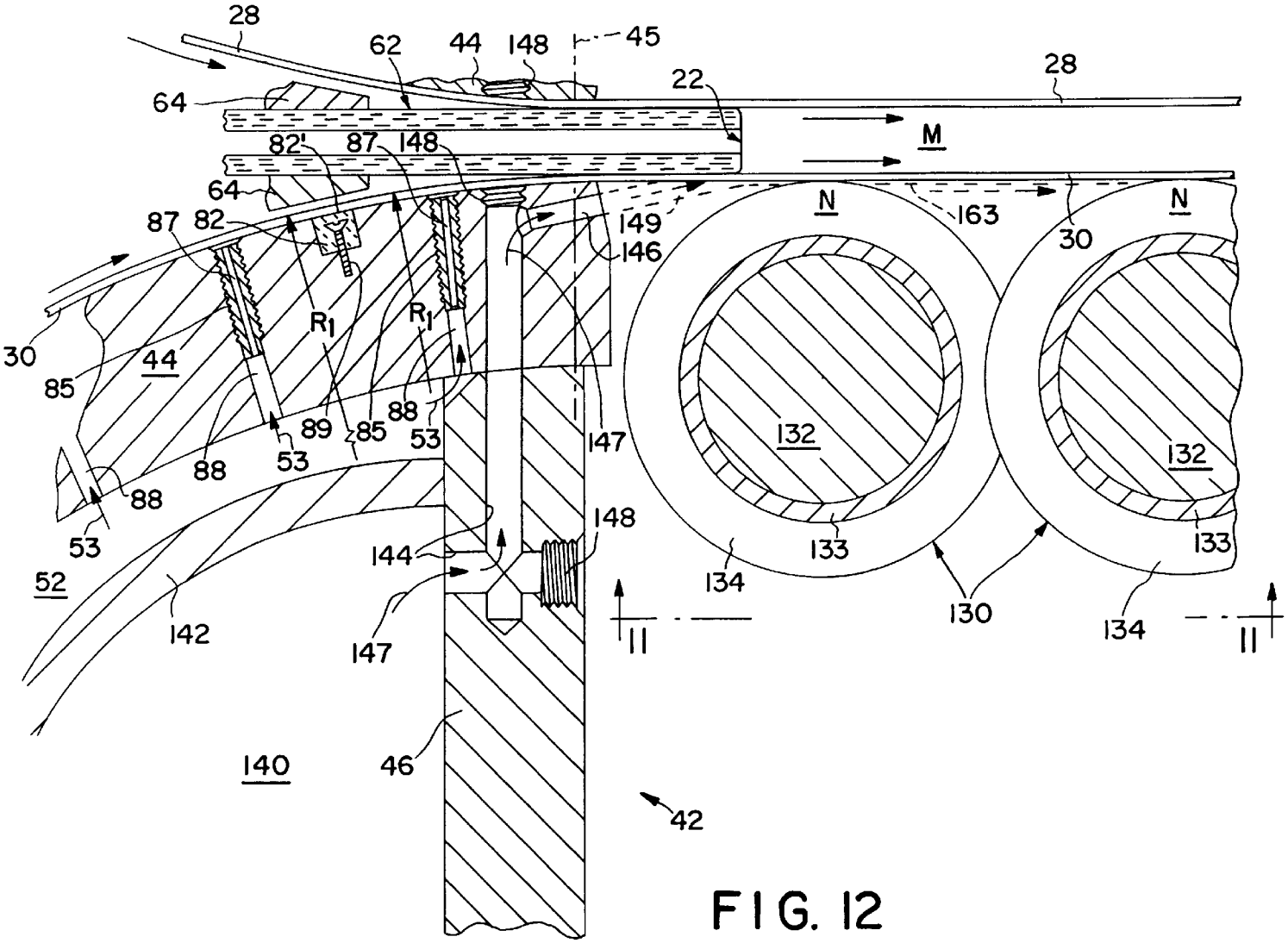
FIG. 12 is a view similar to FIG. 10, wherein a modified embodiment of the apparatus of FIG. 5 includes multiple nozzles (only one nozzle is seen) for applying an initial high-velocity downstream flow of liquid coolant onto the lower belt.

Magnetic backup rollers: In FIGS. 10 and 12, moving belts are shown being guided, stabilized and backed up by backup rollers 130 having magnetized fins as described and claimed in my U.S. Pat. No. 5,728,036, assigned to the same assignee as the present invention. The rotatable shafts 132 and encircling fins 134 are formed of magnetically soft ferromagnetic material. Fins 134 are magnetically energized in alternate north and south polarities (N and S in FIG. 11) by permanent collar magnets 133. "Reach-out" magnetic material may be used advantageously in these collar magnets. These backup rollers 130 may advantageously be assembled closer together than usual by staggering relative positioning of fins 134 to permit interdigitating the fins of one roller to nest between the fins of an adjacent roller as in FIG. 11.

Especially when backup rollers 130 are used, instead of using an array of magnetized hydrodynamic backup elements 116 (FIG. 9), it is essential to cool the casting belts 28, 30 immediately adjacent to mold entrance 22 by a fast-moving layer 163 of liquid coolant, normally water. This fast-moving coolant layer 163 advantageously is applied directly to the belt from air pillow apparatus 40 or 42, because absence of a rotating entrance-pulley drum eliminates limitations imposed by a prior-art "cusp region" as described in the Background.

In FIG. 10 this fast-moving coolant 163 is applied from a transverse deflector 150 having a working shape similar to that disclosed in U.S. Pat. No. 3,041,686 of Hazelett et al. This deflector 150 with its curved area 160 may be made integral with the back wall 46 of the air pillow apparatus as shown in FIG. 10. Pressurized coolant 147 is supplied from a header 152 having a plurality of nozzles 154 (only one is seen), whence coolant impinges as jets 156 at a small angle against the deflector 150. There, the coolant spreads sideways to become a moving film 158 which races around curve 160 to leave the deflector as a relatively flat, fast-moving sleet 162 which creates coolant layer 163.

In FIG. 12 the application of fast-travelling coolant layer 163 onto the casting belt is accomplished by a plurality of nozzles 146 (only one is seen). These nozzles and their coolant-feed passages 144 are shown constructed integral with the air pillow apparatus. Conveniently, a header 142 to enclose a coolant plenum 140 is fitted right into part of the volume of the air plenum chamber 52, as shown in FIG. 12, where only a portion of the header 142 is shown. Emerging coolant jets 149 from nozzles 146 create fast-moving coolant layer 163. The direction of coolant flow is shown by arrows 147. Plugs 148 seal passages 144 where required.

Magnetized hydromagnetic elements 116 shown in outline in FIG. 9 as disclosed and claimed in PCT application of Kagan et al, referenced above, may be employed rather than the backup rollers 130 in FIG. 12. Then, the coolant jets 149 sweep downstream and clear away from between spaced parallel elements 116 spent hydrodynamic coolant emerging from the outlets (not shown) in the elements 116. Further, these powerful coolant jets 149 serve to maintain a fast-moving flow of coolant layer 163 continuing downstream just past downstream ends (not shown) of elements 116.

Preheating the casting belts ahead of the entrance 22 to the mold M prevents unwanted belt distortion and hence permits production of improved product as explained in U.S. Pat. No. 3,937,270 of Hazelett et al., assigned to the same assignee as the present invention. The effect of preheating is thoroughly analyzed and illustrated in three U.S. patents of Hazelett and Wood, assigned to the same assignee as the present invention. U.S. Pat. No. 4,002,197 discloses liquid and steam means of preheating but especially radiant preheating as by intensive infra-red heaters. U.S. Pat. No. 4,062,235 discloses devices for sensing the warping or thermally induced movement of a casting belt in the mold, that is, sensing the beneficial effect of belt preheating. U.S. Pat. No. 4,082,101 discloses devices to ensure that the coolant for the belts in the mold covers barely more than the area of the belt touched by hot metal in the mold. U.S. Pat. No. 5,133,402 of Ross discloses another dry method of belt preheating, the method of electromagnetic inductive preheating at a frequency, for instance, of 3,000 hertz applied through a loop of copper pipe near to the casting belt surface, through which pipe flows water to keep the copper from melting because of the high amperage.

The compressed air which is employed to levitate a casting belt as it wraps upon the air pillow apparatus contains or absorbs only a small amount of heat energy. The adjacent flow of compressed air does not much alter the preheat of a casting belt. Any contact of the belt with water or liquid coolant would, on the contrary, dominate the temperature of the belt, regardless of heat previously applied to it. While air pillow apparatus disclosed herein would make possible (as it was not done by Sivilotti) the use of heated water for belt preheating at temperatures as high as 93 degrees C. (200° F.), such heated coolant procedure is complicated and is a radically inefficient use of energy. Moreover, radiant heat, or other dry, nonwetting heating applied to the belt in proximity to the air pillow apparatus 40 and 42 is efficient and versatile in raising the temperature of an air-levitated casting belt to a desired preheat to a temperature between about 80° C. (about 176° F.) and about 150 degrees C. (about 302 degrees F.).

The use of a levitating fluid reduces or eliminates the contact pressure of the belts sliding against the supporting surfaces provided by the air pillow apparatus and hence reduces thermal conduction resulting from such contact. If the levitating fluid is air, even cool air, then the belts can still retain nearly all of their applied energy of preheat and not lose it to the guiding sliding surfaces. Without this partial or full levitation by air, substantial preheat would be drawn away from the casting belts as they slide over their supports. Moreover, any belt-preheat liquid applied anywhere near the mold entrance, near to molten metal, would require careful disposal to avoid explosion. Compressed air at and below normal shop-air pressure As described is readily available, is easily handled, and conveniently may be allowed to escape to ambient as described.

Although specific presently preferred embodiments of the invention have been disclosed herein in detail, it is to be understood that these examples of the invention have been described for purposes of illustration. This disclosure is not to be construed as limiting the scope of the invention, since the described methods and apparatus may be changed in details by those skilled in the art of continuous casting of metals, in order to adapt these methods and apparatus to be useful in particular casting machines or situations, without departing from the scope of the following claims. For instance, the foregoing discussion has been in terms of a nearly horizontal twin-belt casting machine having upper and lower carriages, whereas the invention may be embodied and employed in casting machines operating at any angle from horizontal to vertically downward. Again, the invention can be embodied and employed in terms of single-belt casters having a relatively flat casting zone. It is understood that downstream equipment might be arranged to permit the use of coolant layers 163 travelling across the casting belts instead of longitudinally along them, or perimetral seals might be multiple rather than unitary.

I claim:

1. Air-pillow apparatus for guiding a moving, flexible, tensed, heat-conductive metallic casting belt along a cylindrically shaped path wherein the cylindrically shaped path is suitable for guiding such a casting belt moving toward an entrance into a mold space of a continuous casting machine for continuously casting molten metal, said air-pillow apparatus comprising:

a plurality of stationary belt-guiding elements defining the cylindrically shaped path;

said belt-guiding elements being arranged for association with pressurized air for applying pressurized air in belt-levitating relationship against a cylindrically curved inner surface of such a casting belt moving along the cylindrically shaped path; and said stationary belt-guiding elements being located at a plurality of positions spaced from each other and arranged in a pattern extending transversely across said cylindrically shaped path.

2. Air-pillow apparatus claimed in claim 1, further comprising:

a fixed, stationary support for said belt-guiding elements having said belt-guiding elements thereon;

said belt-guiding elements defining a cylindrically shaped path spanning an angle "A" in a range from a few degrees up to about 270°;

said support having at least one passage for feeding pressurized air into contact with said belt-guiding elements; and said support having mounting members for mounting the air-pillow apparatus in fixed, stationary position in a continuous casting machine near the entrance into the mold space.

3. Air-pillow apparatus claimed in claim 2, wherein:

said at least one passage includes a nozzle for controlling pressure of pressurized air being fed into contact with said belt-guiding elements.

4. Air-pillow apparatus claimed in claim 2, wherein:

said belt-guiding elements have stationary surfaces for facing outward toward a cylindrically curved moving inner surface of such a casting belt moving along the cylindrically shaped path; and said surfaces of said belt-guiding elements include suitable, durable, wear-resistant, slippery material.

5. Air-pillow apparatus for guiding a moving, flexible, tensed, heat-conductive casting belt along a cylindrically shaped path wherein the cylindrically shaped path is suitable for guiding such a casting belt moving toward an entrance into a mold space of a continuous casting machine, said air-pillow apparatus comprising:

a plurality of stationary belt-guiding elements defining the cylindrically shaped path;

said belt-guiding elements being arranged for association with pressurized air for applying pressurized air in belt-levitating relationship against a cylindrically curved inner surface of such a casting belt moving along the cylindrically shaped path; and further comprising:

an elongated, stationary air-throttling barrier extending across the cylindrically shaped path for positioning generally transverse to motion of such a casting belt moving along the cylindrically shaped path.

6. Air-pillow apparatus claimed in claim 5, further comprising:

said elongated air-throttling barrier having a stationary surface facing outward for facing toward a cylindrically curved moving inner surface of such a casting belt moving along the cylindrically shaped path; and said surface of said elongated air-throttling barrier having pressure-extension grooves therein.

7. Air-pillow apparatus claimed in claim 5, further comprising:

a stationary perimetral seal extending around said cylindrically shaped path for positioning in operative association with a cylindrically curved moving inner surface of such a casting belt moving along the cylindrically shaped path for restricting escape of pressurized air away from the curved moving inner surface of such a casting belt; and said elongated air-throttling barrier is a portion of said perimetral seal.

8. Air-pillow apparatus claimed in claim 6, further comprising:

a lip on said elongated air-throttling barrier;

said lip extending longitudinally along said elongated air-throttling barrier;

said pressure-extension grooves in said surface of said elongated air-throttling barrier including an elongated groove in said surface extending longitudinally along said elongated air-throttling barrier;

said elongated groove being adjacent to said lip;

said pressure-extension grooves including a plurality of spaced parallel grooves communicating with said elongated groove and being on an opposite side of said groove from said lip; and said spaced parallel grooves being oriented generally perpendicular to said elongated groove for said spaced parallel grooves to be positionable generally parallel with the motion of such a casting belt moving along the cylindrically shaped path and for said spaced parallel grooves to be positionable in communication with pressurized air in belt-levitating relationship against a cylindrically curved moving inner surface of such a casting belt moving along the cylindrically shaped path.

9. Air-pillow apparatus claimed in claim 8, wherein:

said elongated groove is deeper than said spaced parallel grooves communicating with said elongated groove.

10. Air-pillow apparatus claimed in claim 2, further comprising:

said fixed, stationary support having said belt-guiding elements thereon being a member having a convex outer surface;

said belt-guiding elements being on said convex outer surface;

said convex outer surface conforming generally with and being spaced inwardly from the cylindrically shaped path defined by said outwardly facing, stationary surfaces of said belt-guiding elements; and said belt-guiding elements being arranged in said predetermined pattern on said convex outer surface of said cylindrical shell.

11. Air-pillow apparatus claimed in claim 1, wherein:

the cylindrically shaped path has a constant radius R1; and said constant radius R1 has a length in the range from about 200 millimeters to about 400 millimeters (about 7.9 inches to about 15.8 inches.

12. Air-pillow apparatus for guiding a moving, flexible, tensed, heat-conductive casting belt along a cylindrically shaped path wherein the cylindrically shaped path is suitable for guiding such a casting belt moving toward an entrance into a mold space of a continuous casting machine, said air-pillow apparatus comprising:

a plurality of stationary belt-guiding elements defining the cylindrically shaped path;

said belt-guiding elements being arranged for association with pressurized air for applying pressurized air in belt-levitating relationship against a cylindrically curved inner surface of such a casting belt moving along the cylindrically shaped path;

wherein:

the cylindrically shaped path has a constant radius R1;

said convex outer surface spans an angle "A" of about 180°; and the constant radius R1 has a length in the range of about 200 millimeters to about 400 millimeters (about 7.9 inches to about 15.8 inches).

13. Air-pillow apparatus for guiding a moving, flexible, tensed, heat-conductive casting belt along a cylindrically shaped path wherein the cylindrically shaped path is suitable for guiding such a casting belt moving toward an entrance into a mold space of a continuous casting machine, said air-pillow apparatus comprising:

a plurality of stationary belt-guiding elements defining the cylindrically shaped path;

said belt-guiding elements being arranged for association with pressurized air for applying pressurized air in belt-levitating relationship against a cylindrically curved inner surface of such a casting belt moving along the cylindrically shaped path;

wherein:

the cylindrically shaped path has a constant radius R1;

the cylindrically shaped path includes a cylindrically shaped flexural transition region of variable radius R+;

the variable radius R+ of said cylindrically shaped flexural transition region progressively increasing in length relative to said length of constant radius R1 for progressively decreasing curvature of said cylindrically shaped flexural transition region for reducing flexure of such a casting belt moving along the cylindrically shaped transition region toward an entrance into a mold space of a continuous casting machine.

14. Air-pillow apparatus claimed in claim 13, wherein:

said cylindrically shaped flexural transition region of variable radius R+ extends along a gradually straightening curve.

15. Air-pillow apparatus claimed in claim 14, wherein:

said gradually straightening curve is similar to a railway transitional curve.

16. Air-pillow apparatus claimed in claim 14, wherein:

said air-pillow apparatus is adapted for guiding such a casting belt moving toward an entrance into a mold space in a continuous casting machine wherein the mold space extends substantially flat from the entrance along a generally straight downstream direction in the continuous casting machine;

said gradually straightening curve follows a formula:

$$Y=aX^3;$$

where "a" is on the order of $1/70{,}000$ and both dimension X and dimension Y are measured in millimeters;

dimension X is measured in a direction away from the entrance; and said direction away from the entrance is opposite to said downstream direction.

17. Air-pillow apparatus claimed in claim 14, wherein:

said air-pillow apparatus is adapted to be installed in a continuous casting machine near an entrance into a mold space in the machine wherein said mold space extends substantially flat from the entrance along a generally straight downstream direction and wherein the machine has a plurality of members positioned near the entrance into the mold space for guiding such a casting belt moving along a portion of said cylindrically shaped flexural transition region and into said entrance;

said portion of said cylindrically shaped flexural transition region extends along said gradually straightening curve; and said gradually straightening curve has a curvature which becomes substantially zero at the entrance into the mold space, thereby providing gradually decreasing stress within such a casting belt moving along said portion of said cylindrically shaped flexural transition region of gradually decreasing curvature and into said entrance, said gradually straightening curve initially having curvature with the radius R1 followed by an increasing variable radius R+ whose reciprocal 1/R+ becomes substantially zero at said entrance for providing substantially zero curvature at the entrance, whereby such a moving casting belt travels through the entrance without significant flexure at the entrance and continues travelling downstream from the entrance along said generally straight downstream direction.

18. Air-pillow apparatus for guiding a moving, flexible, tensed, heat-conductive casting belt along a cylindrically shaped path wherein the cylindrically shaped path is suitable for guiding such a casting belt moving toward an entrance into a mold space of a continuous casting machine, said air-pillow apparatus comprising:

a plurality of stationary belt-guiding elements defining the cylindrically shaped path;

said belt-guiding elements being arranged for association with pressurized air for applying pressurized air in belt-levitating relationship against a cylindrically curved inner surface of such a casting belt moving along the cylindrically shaped path;

further comprising:

a fixed, stationary support for said belt-guiding elements having said belt-guiding elements thereon;

said support having at least one passage for feeding pressurized air into contact with said belt-guiding elements;

said support having mounting members for mounting the air-pillow apparatus in fixed, stationary position in a continuous casting machine near the entrance into the mold space;

said fixed, stationary support having said belt-guiding elements thereon being a member having a convex outer surface;

said belt-guiding elements being on said convex outer surface;

said convex outer surface conforming generally with and being spaced inwardly from the cylindrically shaped path defined by said outwardly facing, stationary surfaces of said belt-guiding elements;

said member being a cylindrical shell;

end walls and a back member secured to said cylindrical shell enclosing a plenum chamber adjacent to an inner concave surface of said cylindrical shell;

said belt-guiding elements forming a stationary grid on said convex outer surface;

said grid having a generally rectangular pattern with belt-guiding elements of the rectangular pattern forming walls of a multiplicity of rectangular depressions on said convex outer surface;

said convex outer surface defining floors of said rectangular depressions; and said cylindrical shell having a multiplicity of passages extending therethrough from said concave inner surface to said convex outer surface for providing communication from the plenum chamber through floors of the rectangular depressions for feeding pressurized air from the plenum chamber into said shallow depressions.

19. Air-pillow apparatus claimed in claim 18, wherein:

individual passages provide communication from said plenum chamber through respective floor of individual rectangular depressions for individually feeding pressurized air into respective depressions.

20. Air-pillow apparatus claimed in claim 19, further comprising:

a plurality of air-pressure controlling nozzles; and nozzles of said plurality being mounted individually in respective passages.

21. Air-pillow apparatus claimed in claim 18, further comprising:

a monolithic grid having belt-guiding elements of suitable, durable, wear-resistant, slippery material arranged in said generally rectangular pattern;

said convex outer surface of said cylindrical shell having a grid of grooves matching said generally rectangular pattern of said monolithic grid;

said monolithic grid being mounted in said grid of grooves in snugly fitting relationship therein;

said monolithic grid protruding by a small elevation "h" above the floors of said rectangular depressions; and said small elevation "h" being in a range between about 25 microns and about 2.5 millimeters.

22. Air-pillow apparatus claimed in claim 18, further comprising:

a multiplicity of strips of suitable, durable, wear-resistant slippery material;

said convex outer surface of said cylindrical shell having a grid of grooves matching said generally rectangular pattern;

said strips being mounted in said grooves in snugly fitting relationship therein for forming said grid having a generally rectangular pattern;

said strips protruding by a small elevation "h" above the floors of said rectangular depressions; and said small elevation "h" being in a range between about 25 microns and about 2.5 millimeters.

23. Air-pillow apparatus for guiding a moving, flexible, tensed, heat-conductive casting belt along a cylindrically shaped path wherein the cylindrically shaped path is suitable for guiding such a casting belt moving toward an entrance into a mold space of a continuous casting machine, said air-pillow apparatus comprising:

a plurality of stationary belt-guiding elements defining the cylindrically shaped path;

said belt-guiding elements being arranged for association with pressurized air for applying pressurized air in belt-levitating relationship against a cylindrically curved inner surface of such a casting belt moving along the cylindrically shaped path;

further comprising:

a fixed, stationary support for said belt-guiding elements having said belt-guiding elements thereon;

said support having at least one passage for feeding pressurized air into contact with said belt-guiding elements;

said support having mounting members for mounting the air-pillow apparatus in fixed, stationary position in a continuous casting machine near the entrance into the mold space;

said fixed, stationary support having said belt-guiding elements thereon being a member having a convex outer surface;

said belt-guiding elements being on said convex outer surface;

said convex outer surface conforming generally with and being spaced inwardly from the cylindrically shaped path defined by said outwardly facing, stationary surfaces of said belt-guiding elements;

said member being a cylindrical shell;

end walls and a back wall secured to said cylindrical shell enclosing a plenum chamber adjacent to an inner concave surface of said cylindrical shell; and said belt-guiding elements being arranged in a predetermined pattern on said convex outer surface of said cylindrical shell.

24. Air-pillow apparatus for guiding a moving, flexible, tensed, heat-conductive casting belt along a cylindrically shaped path wherein the cylindrically shaped path is suitable for guiding such a casting belt moving toward an entrance into a mold space of a continuous casting machine, said air-pillow apparatus comprising:

a plurality of stationary belt-guiding elements defining the cylindrically shaped path;

said belt-guiding elements being arranged for association with pressurized air for applying pressurized air in belt-levitating relationship against a cylindrically curved inner surface of such a casting belt moving along the cylindrically shaped path;

further comprising:

a fixed, stationary support for said belt-guiding elements having said belt-guiding elements thereon;

said support having at least one passage for feeding pressurized air into contact with said belt-guiding elements;

said support having mounting members for mounting the air-pillow apparatus in fixed, stationary position in a continuous casting machine near the entrance into the mold space;

said fixed, stationary support having said belt-guiding elements thereon being a member having a convex outer surface;

said belt-guiding elements being on said convex outer surface;

said convex outer surface conforming generally with and being spaced inwardly from the cylindrically shaped path defined by said outwardly facing, stationary surfaces of said belt-guiding elements;

said member being a cylindrical shell;

end walls and a back wall secured to said cylindrical shell enclosing a plenum chamber adjacent to an inner concave surface of said cylindrical shell;

said belt-guiding elements being arranged in a predetermined pattern on said convex outer surface of said cylindrical shell;

said belt-guiding elements are elongated;

said elongated belt-guiding elements are in spaced parallel relationship;

said spaced parallel elongated belt-guiding elements extend along said cylindrically shaped path in a circumferential direction generally parallel with movement of such a casting belt moving along the cylindrically curved path; and spaces between said spaced parallel elongated belt-guiding strips define channels having a width not exceeding about 150 times a thickness of such a casting belt moving along the cylindrically shaped path;

such thickness is in a range from about 0.3 mm (about 0.012 of an inch) to about 2 mm (about 0.079 of an inch); and said cylindrical shell has passages extending therethrough providing communication between the plenum chamber and said channels.

25. Air-pillow apparatus claimed in claim 23, wherein:

said belt-guiding elements are rectangular plateaus arranged in a rectangular grid pattern defining channels therebetween whose floors are said convex outer surface; and said cylindrical shell has passages extending therethrough and extending out through central points on outer surfaces of said rectangular plateaus.

26. Air-pillow apparatus claimed in claim 25, wherein:

said plateaus protrude above said floors by an elevation "h"; and said elevation "h" is in a range between about 25 microns and about 2.5 millimeters.

27. Air-pillow apparatus for guiding a moving, flexible, tensed, heat-conductive casting belt along a convex cylindrically shaped path wherein the convex cylindrically shaped path is suitable for guiding such a casting belt moving toward an entrance into a mold space of a continuous casting machine, said air-pillow apparatus comprising:

a multiplicity of spaced, stationary elements having spaces therebetween;

said spaced, stationary elements having stationary belt-guiding surfaces;

said belt-guiding surfaces being laterally spaced across said convex, cylindrically shaped path;

said belt-guiding surfaces facing outwardly along said convex, cylindrically shaped path for guiding such a casting belt moving along said path with a cylindrically curved moving inner surface of the moving belt facing said belt-guiding surfaces; and said air-pillow apparatus having at least one passage for feeding pressurized air into said spaces between said elements for providing pressurized air in levitating contact with said cylindrically curved moving inner surface of the moving belt.

28. Air-pillow apparatus claimed in claim 27, wherein:

said tensed belt exerts a first force component of predetermined magnitude directed toward said air-pillow apparatus;

said pressurized air feeding into said spaces between said elements is controllable for providing controlled pressurized air in levitating contact with said cylindrically curved moving inner surface of the moving belt for exerting on said cylindrically curved moving inner surface a second force component having a magnitude which is at least about 90% of said predetermined magnitude of said first force component; and said second force component is directed away from said air-pillow apparatus and is in opposition to said first force component.

29. Air-pillow apparatus claimed in claim 27, wherein:

said tensed belt exerts a first force component of predetermined magnitude of about 125 newtons per millimeter of belt width directed toward said air-pillow apparatus;

said pressurized air feeding into said spaces between said elements is controllable for providing controlled pressurized air in levitating contact with said cylindrically curved moving inner surface of the moving belt for exerting on said cylindrically curved moving inner surface a second force component having a magnitude which is at least about 90% of said predetermined magnitude of said first force component; and said second force component is directed away from said air-pillow apparatus and is in opposition to said first force component.

30. Air-pillow apparatus for guiding a moving, flexible, tensed, heat-conductive casting belt along a cylindrically shaped path wherein the cylindrically shaped path is suitable for guiding such a casting belt moving toward an entrance into a mold space of a continuous casting machine, said air-pillow apparatus comprising:

a multiplicity of spaced, stationary elements having spaces therebetween;

said spaced, stationary elements having stationary belt-guiding surfaces;

said belt-guiding surfaces being arranged along a convex, cylindrically shaped path;

said belt-guiding surfaces facing outwardly along said convex, cylindrically shaped path for guiding such a casting belt moving along said path with a cylindrically curved moving inner surface of the moving belt facing said belt-guiding surfaces;

said air-pillow apparatus having at least one passage for feeding pressurized air into said spaces between said elements for providing pressurized air in levitating contact with said cylindrically curved moving inner surface of the moving belt;

said tensed belt exerts a first force component of predetermined magnitude directed toward said air-pillow apparatus;

said pressurized air feeding into said spaces between said elements is controllable for providing controlled pressurized air in levitating contact with said cylindrically curved moving inner surface of the moving belt for exerting on said cylindrically curved moving inner surface a second force component having a magnitude which is at least about 90% of said predetermined magnitude of said first force component;

said second force component is directed away from said air-pillow apparatus and is in opposition to said first force component;

said pressurized air feeding into said spaces between said elements is controllable for providing controlled pressurized air in levitating contact with said cylindrically curved moving inner surface of the moving belt for exerting on said cylindrically curved moving inner surface a second force component having a magnitude which is in a range between about 99% and 100% of said predetermined magnitude of said first force component;

said second force component is directed away from said air-pillow apparatus and is in opposition to said first force component;

said mold space extending substantially flat from the entrance along a generally straight downstream direction;

said mold space having an upstream direction opposite to said downstream direction;

said convex, cylindrically shaped path spanning an included angle of about 180°;

said convex, cylindrically shaped path having a radius R1 having a length in the range of about 200 millimeters to about 400 millimeters (about 7.9 inches to about 15.8 inches); and said controlled pressurized air in levitating contact with said cylindrically curved moving inner surface of the moving belt exerting a force component in the upstream direction which is about 250 newtons per millimeter of belt width.

31. Air-pillow apparatus claimed in claim 27, further comprising:

a support having an exterior of generally convex, cylindrical shape; and said spaced, stationary elements being on said exterior of said support.

32. Air-pillow apparatus for guiding a moving, flexible tensed, heat-conductive casting belt along a cylindrically shaped path wherein the cylindrically shaped path is suitable for guiding such a casting belt moving toward an entrance into a mold space of a continuous casting machine, said air-pillow apparatus comprising:

a multiplicity of spaced, stationary elements having spaces therebetween;

said spaced, stationary elements having stationary belt-guiding surfaces;

said belt-guiding surfaces being arranged along a convex, cylindrically shaped path;

said belt-guiding surfaces facing outwardly along said convex, cylindrically shaped path for guiding such a casting belt moving along said path with a cylindrically curved moving inner surface of the moving belt facing said belt-guiding surfaces;

said air-pillow apparatus having at least one passage for feeding pressurized air into said spaces between said elements for providing pressurized air in levitating contact with said cylindrically curved moving inner surface of the moving belt;

further comprising:

a support having an exterior of generally convex, cylindrical shape;

said spaced, stationary elements being on said exterior of said support;

said spaced stationary elements being a grid on said exterior of said support;

said grid extending along said convex, cylindrically shaped path; and said belt-guiding surfaces being outwardly facing surfaces of said grid.

33. Air-pillow apparatus claimed in claim 32, further comprising:

said belt-guiding surfaces of said grid being in a generally rectangular pattern.

34. Air-pillow apparatus claimed in claim 33, further comprising:

said grid on said exterior of said support defining a multiplicity of depressions on said exterior of said support;

said depressions facing outwardly toward the cylindrically curved moving inner surface of the moving belt; and said air-pillow apparatus having a multiplicity of passages communicating with said depressions for feeding pressurized air into said depressions for being in levitating contact with said cylindrically curved moving inner surface of the moving belt as the belt moves over said depressions.

35. Air-pillow apparatus claimed in claim 34, further comprising:

a plurality of air-pressure controlling nozzles;

said passages communicating individually with said depressions; and one of said nozzles being in each of said passages for controlling pressure of pressurized air feeding into the depressions for controlling pressure of air in levitating contact with said cylindrically curved moving inner surface of the moving belt as the belt moves over said depressions.

36. Air-pillow apparatus claimed in claim 35, further comprising:

said support being a cylindrically shaped shell having said exterior of generally convex, cylindrical shape;

said cylindrically shaped shell having an interior communicating with a plenum chamber; and said multiplicity of passages extending from said plenum chamber through said shell into said depressions.

37. Air-pillow apparatus claimed in claim 23, wherein:

said belt-guiding elements comprise a plurality of ridge strips extending along said cylindrically shaped path in a circumferential direction;

said ridge strips defining circumferential channels therebetween;

said ridge strips being interrupted by transverse gaps;

said transverse gaps having circumferential lengths of less than about 10 millimeters (about 0.39 of an inch); and said cylindrical shell having at least one passage therethrough providing communication from said plenum chamber into a circumferential channel; and said at least one passage being positioned in a centralized location among said ridge strips.

38. Air-pillow apparatus claimed in claim 37, further comprising:

a nozzle for controlling pressure of pressurized air; and said nozzle being associated with said at least one passage for controlling pressure of air flowing from said plenum chamber through said passage.

39. Air-pillow apparatus claimed in claim 23, wherein:

said air-pillow apparatus is adapted for guiding such a casting belt moving toward an entrance into a mold space in a continuous casting machine wherein the mold space extends from the entrance along a downstream direction;

said air-pillow apparatus further comprising:

a coolant deflector associated with said back wall;

said coolant deflector having a curved area for applying coolant to an inner surface of such a casting belt moving in the downstream direction near said entrance; and said curved area is configured for applying coolant in the downstream direction to said inner surface.

40. Air-pillow apparatus claimed in claim 39, wherein:

said deflector is formed integral with said back wall.

41. Air-pillow apparatus claimed in claim 23, wherein:

said air-pillow apparatus is adapted for guiding such a casting belt moving toward an entrance into a mold space in a continuous casting machine wherein the mold space extends from the entrance along a downstream direction;

said air-pillow apparatus further comprising:

a plurality of coolant application nozzles; and said coolant application nozzles being aimed generally in the downstream directions for applying coolant to an inner surface of such a casting belt moving in the downstream direction near said entrance.

42. Air-pillow apparatus claimed in claim 41, further comprising:

a coolant plenum within said plenum chamber; and said coolant plenum communicating with said coolant application nozzles for feeding coolant into said nozzles.

43. Air-pillow apparatus claimed in claim 42, wherein:

said coolant nozzles are formed integral with the air-pillow apparatus.

44. Air-pillow apparatus for use in a continuous casting machine having at least one endless, flexible, tensed, heat-conductive casting belt revolvable along a closed loop wherein a tensed moving casting belt travels in a downstream direction along a mold space from an entrance into the mold space to an exit therefrom and returns from the exit to the entrance along a return portion of the closed loop, said return portion of the closed loop being positioned away from the mold space, and wherein tensile stress in the tensed moving casting belt accords with operating practice known in the art for such a continuous casting machine, said air-pillow apparatus comprising:

a multiplicity of stationary elements;

said stationary elements having working surfaces defining a cylindrically shaped path extending from said return portion of the closed loop toward the entrance into the mold space for guiding a tensed moving casting belt along said cylindrically shaped path with a cylindrically curved moving inner surface of a moving casting belt being adjacent to said working surfaces; and a source of pressurized air for feeding pressurized belt-levitating air to said stationary elements for pressing outwardly away from the air-pillow apparatus against a cylindrically curved moving inner surface of the tensed moving casting belt for carrying at least about 90% of an overall downstream-directed component of force exertable upon the air-pillow apparatus by the tensed revolving casting belt.

45. Air-pillow apparatus claimed in claim 44, further comprising:

an air-pillow shell having a convex, generally cylindrical exterior and having an interior;

said multiplicity of stationary elements being on said exterior;

the air-pillow apparatus including walls secured to the air-pillow shell defining a plenum chamber communicating with said interior of the air-pillow shell;

the air-pillow apparatus including members for mounting the air-pillow apparatus in a continuous casting machine near the entrance into the mold space;

said air-pillow shell having at least one passage therethrough from the plenum chamber to said exterior; and said source of pressurized air is said plenum chamber in association with said at least one passage through said air-pillow shell.

46. Air-pillow apparatus for use in a continuous casting machine having at least one endless, flexible, tensed, heat-conductive casting belt revolvable along a closed loop wherein a tensed moving casting belt travels in a downstream direction along a mold space from an entrance into the mold space to an exit therefrom and returns from the exit to the entrance along a return portion of the closed loop, said return portion of the closed loop being positioned away from the mold space, said air-pillow apparatus comprising:

a multiplicity of stationary elements;

said stationary elements having working surfaces defining a cylindrically shaped path extending from said return portion of the closed loop toward the entrance into the mold space for guiding a moving casting belt along said cylindrically shaped path with a cylindrically curved moving inner surface of a moving casting belt being adjacent to said working surfaces;

a source of pressurized air for feeding pressurized belt-levitating air to said stationary elements for pressing outwardly away from the air-pillow apparatus against a cylindrically curved moving inner surface of a moving casting belt for carrying at least about 90% of an overall downstream-directed component of force exertable upon the air-pillow apparatus by a tensed revolving casting belt;

further comprising:

an air-pillow shell having a convex, generally cylindrical exterior and having an interior;

said multiplicity of stationary elements being on said exterior;

the air-pillow apparatus including walls secured to the air-pillow shell defining a plenum chamber communicating with said interior of the air-pillow shell;

the air-pillow apparatus including members for mounting the air-pillow apparatus in a continuous casting machine near the entrance into the mold space;

said air-pillow shell having at least one passage therethrough from the plenum chamber to said exterior;

said source of pressurized air is said plenum chamber in association with said at least one passage through said air-pillow shell;

in which:

said pressurized belt-levitating air pressing outwardly against a cylindrically curved moving inner surface of a moving casting belt exerts a force component in an upstream direction on a moving casting belt which is about 250 newtons per millimeter of belt width; and said force component in an upstream direction results in a tensile stress in a moving casting belt of about 10,000 newtons per square centimeter of cross section of the moving casting belt, which is a tensile stress approximating a customary tensile stress previously used in such a continuous casting machine.

47. Air-pillow apparatus for use in a continuous casting machine having at least one endless, flexible, tensed, heat-conductive casting belt revolvable along a closed loop wherein a tensed moving casting belt travels in a downstream direction along a mold space from an entrance into the mold space to an exit therefrom and returns from the exit to the entrance along a return portion of the closed loop, said return portion of the closed loop being positioned away from the mold space, said air-pillow apparatus comprising:

a multiplicity of stationary elements;

said stationary elements having working surfaces defining a cylindrically shaped path extending from said return portion of the closed loop toward the entrance into the mold space for guiding a moving casting belt along said cylindrically shaped path with a cylindrically curved moving inner surface of a moving casting belt being adjacent to said working surfaces;

a source of pressurized air for feeding pressurized belt-levitating air to said stationary elements for pressing outwardly away from the air-pillow apparatus against a cylindrically curved moving inner surface of a moving casting belt for carrying at least about 90% of an overall downstream-directed component of force exertable upon the air-pillow apparatus by a tensed revolving casting belt;

further comprising:

an air-pillow shell having a convex, generally cylindrical exterior and having an interior;

said multiplicity of stationary elements being on said exterior;

the air-pillow apparatus including walls secured to the air-pillow shell defining a plenum chamber communicating with said interior of the air-pillow shell;

the air-pillow apparatus including members for mounting the air-pillow apparatus in a continuous casting machine near the entrance into the mold space;

said air-pillow shell having at least one passage therethrough from the plenum chamber to said exterior;

said source of pressurized air is said plenum chamber in association with said at least one passage through said air-pillow shell;

in which:

said stationary elements on said exterior air-pillow shell define isolated regions among said stationary elements;

said isolated regions among the stationary elements when said air-pillow shell is enwrapped by a moving casting belt become isolated belt-levitating chambers positioned below the working surfaces of said stationary elements;

said isolated belt-levitating chambers have a width, measured in a direction transverse to a moving casting belt, which is less than about 150 times said predetermined thickness of the moving casting belt;

said air-pillow shell has a plurality of passages therethrough;

said passages communicate individually with said isolated belt-levitating chambers; and said passages fixedly throttle pressurized air flowing therethrough from the plenum chamber to said stationary elements for providing said pressurized belt-levitating air.

48. Air-pillow apparatus for use in a continuous casting machine having at least one endless, flexible, tensed, heat-conductive casting belt revolvable along a closed loop wherein a tensed moving casting belt travels in a downstream direction along a mold space from an entrance into the mold space to an exit therefrom and returns from the exit to the entrance along a return portion of the closed loop, said return portion of the closed loop being positioned away from the mold space, said air-pillow apparatus comprising:

a multiplicity of stationary elements;

said stationary elements having working surfaces defining a cylindrically shaped path extending from said return portion of the closed loop toward the entrance into the mold space for guiding a moving casting belt along said cylindrically shaped path with a cylindrically curved moving inner surface of a moving casting belt being adjacent to said working surfaces;

a source of pressurized air for feeding pressurized belt-levitating air to said stationary elements for pressing outwardly away from the air-pillow apparatus against a cylindrically curved moving inner surface of a moving casting belt for carrying at least about 90% of an overall downstream-directed component of force exertable upon the air-pillow apparatus by a tensed revolving casting belt;

further comprising:

a stationary support having a convex exterior;

said stationary elements being on said convex exterior;

said working surfaces of said stationary elements defining a cylindrically shaped path;

said cylindrically shaped path having a constant radius R1 along a major circumferential portion of said cylindrically shaped path commencing near said return portion of said loop; and said air-pillow apparatus being configured for defining a minor circumferential portion of said cylindrically shaped path having a varying radius R+ progressively increasing along said minor circumferential portion of said cylindrically shaped path in a direction toward said entrance for progressively reducing curvature of said minor circumferential portion of said cylindrically shaped path in a direction therealong toward said entrance;

thereby progressively reducing flexural stress in a casting belt moving along said minor portion of said cylindrically shaped path toward said entrance.

49. Air-pillow apparatus for use in a continuous casting machine having at least one endless, flexible, tensed, heat-conductive casting belt revolvable along a closed loop wherein a tensed moving casting belt travels in a downstream direction along a mold space from an entrance into the mold space to an exit therefrom and returns from the exit to the entrance along a return portion of the closed loop, said return portion of the closed loop being positioned away from the mold space, said air-pillow apparatus comprising:

a multiplicity of stationary elements;

said stationary elements having working surfaces defining a cylindrically shaped path extending from said return portion of the closed loop toward the entrance into the mold space for guiding a moving casting belt along said cylindrically shaped path with a cylindrically curved moving inner surface of a moving casting belt being adjacent to said working surfaces;

a source of pressurized air for feeding pressurized belt-levitating air to said stationary elements for pressing outwardly away from the air-pillow apparatus against a cylindrically curved moving inner surface of a moving casting belt for carrying at least about 90% of an overall downstream-directed component of force exertable upon the air-pillow apparatus by a tensed revolving casting belt;

further comprising:

a support having a convex exterior of generally cylindrical shape;

said multiplicity of stationary elements being on said convex exterior;

said stationary elements protruding above said convex exterior defining isolated depressions among said stationary elements;

said working surfaces of said stationary elements being at a height "h" above said convex exterior;

said height "h" being in a range between about 25 microns and about 2.5 millimeters;

said source of pressurized air comprising passages communicating individually with said isolated depressions;

said passages individually fixedly-throttling pressurized air feeding individually into said isolated depressions for providing pressurized belt-levitating air in said isolated depressions; and a cylindrically curved moving inner surface of such a casting belt moving along said cylindrically shaped path being in adjacent relationship with respect to said working surfaces and in cooperation with said working surfaces throttling leakage of pressurized belt-levitating air from said isolated depressions;

whereby screeching noises are substantially avoided.

50. Air-pillow apparatus claimed in claim 49, further comprising:

said working surfaces being suitable durable, wear-resistant, slippery material.

51. Air-pillow apparatus claimed in claim 49, further comprising:

said convex exterior having grooves therein; and said multiplicity of stationary elements being formed of suitable, durable, wear-resistant slippery material mounted in said grooves in snug fitting relationship therein and protruding above said convex exterior to said height "h".

52. Air-pillow apparatus for use in a continuous casting machine having at least one endless, flexible, tensed, heat-conductive casting belt revolvable along a closed loop wherein a tensed moving casting belt travels in a downstream direction along a mold space from an entrance into the mold space to an exit therefrom and returns from the exit to the entrance along a return portion of the closed loop, said return portion of the closed loop being positioned away from the mold space, said air-pillow apparatus comprising:

a multiplicity of stationary elements;

said stationary elements having working surfaces defining a cylindrically shaped path extending from said return portion of the closed loop toward the entrance into the mold space for guiding a moving casting belt along said cylindrically shaped path with a cylindrically curved moving inner surface of a moving casting belt being adjacent to said working surfaces;

a source of pressurized air for feeding pressurized belt-levitating air to said stationary elements for pressing outwardly away from the air-pillow apparatus against a cylindrically curved moving inner surface of a moving casting belt for carrying at least about 90% of an overall downstream-directed component of force exertable upon the air-pillow apparatus by a tensed revolving casting belt;

further comprising:

an air-pillow shell having a convex, generally cylindrical exterior and having an interior;

said multiplicity of stationary elements being on said exterior;

the air-pillow apparatus including walls secured to the air-pillow shell defining a plenum chamber communicating with said interior of the air-pillow shell;

the air-pillow apparatus including members for mounting the air-pillow apparatus in a continuous casting machine near the entrance into the mold space;

said air-pillow shell having at least one passage therethrough from the plenum chamber to said exterior;

said source of pressurized air is said plenum chamber in association with said at least one passage through said air-pillow shell;

in which:

said stationary elements on said convex exterior of said air-pillow shell comprise an array of elevated air-throttling, belt-levitating plateaus having thereamong a complementary array of depressed regions which are air-exhaust channels;

said working surfaces are outer surfaces of said belt-levitating plateaus;

said air-pillow shell has a plurality of passages therethrough individually terminating at centers of said working surfaces of said belt-levitating plateaus; and said passages fixedly throttle pressurized air flowing therethrough from the plenum chamber to the centers of said working surfaces of said belt-levitating plateaus.

53. Air-pillow apparatus claimed in claim 52, further comprising:

an elongate, durable, wear-resistant, perimetral air-throttling barrier extending around said array of belt levitating plateaus and also around said array of exhaust channels on the convex exterior of said air-pillow shell; and said perimetral air-throttling barrier restricting escape of pressurized belt-levitating air from said exhaust channels.

54. Air-pillow apparatus claimed in claim in which:

said perimetral air-throttling barrier has an outwardly facing surface with fine grooves in said surface; and said fine grooves distribute escaping pressurized belt-levitating air over much of the surface of said perimetral air-throttling barrier.

55. Air-pillow apparatus for use in a continuous casting machine having at least one endless, flexible, tensed, heat-conductive casting belt revolvable along a closed loop wherein a tensed moving casting belt travels in a downstream direction along a mold space from an entrance into the mold space to an exit therefrom and returns from the exit to the entrance along a return portion of the closed loop, said return portion of the closed loop being positioned away from the mold space, said air-pillow apparatus comprising:

a multiplicity of stationary elements;

said stationary elements having working surfaces defining a cylindrically shaped path extending from said return portion of the closed loop toward the entrance into the mold space for guiding a moving casting belt along said cylindrically shaped path with a cylindrically curved moving inner surface of a moving casting belt being adjacent to said working surfaces;

a source of pressurized air for feeding pressurized belt-levitating air to said stationary elements for pressing outwardly away from the air-pillow apparatus against a cylindrically curved moving inner surface of a moving casting belt for carrying at least about 90% of an overall downstream-directed component of force exertable upon the air-pillow apparatus by a tensed revolving casting belt;

further comprising:

an air-pillow shell having a convex, generally cylindrical exterior and having an interior;

said multiplicity of stationary elements being on said exterior;

the air-pillow apparatus including walls secured to the air-pillow shell defining a plenum chamber communicating with said interior of the air-pillow shell;

the air-pillow apparatus including members for mounting the air-pillow apparatus in a continuous casting machine near the entrance into the mold space;

said air-pillow shell having at least one passage therethrough from the plenum chamber to said exterior;

said source of pressurized air is said plenum chamber in association with said at least one passage through said air-pillow shell;

in which:

said stationary elements on said convex exterior of said air-pillow shell comprise an array of protruding air-throttling barriers having thereamong a complementary array of depressions;

said air-pillow shell has a plurality of passages therethrough individually terminating at centers of said depressions; and said passages fixedly throttle pressurized air flowing therethrough from the plenum chamber to the centers of said depressions.

56. Air-pillow apparatus claimed in claim 55, further comprising:

an elongate perimetral air-throttling barrier extending around said array of protruding air-throttling barriers and also around said array of depressions on the convex exterior of said air-pillow shell; and said perimetral air-throttling barrier restricting escape of pressurized belt-levitating air from said depressions.

57. Air-pillow apparatus claimed in claim 56, in which:

said perimetral air-throttling barrier has an outwardly facing surface with fine grooves in said surface; and said fine grooves distribute escaping pressurized belt-levitating air over much of the surface of said perimetral air-throttling barrier.

* * * * *